US011648787B2

(12) United States Patent
Hashizume et al.

(10) Patent No.: US 11,648,787 B2
(45) Date of Patent: May 16, 2023

(54) SUPPLY DEVICE, PROCESSING DEVICE, CONTROL METHOD AND PROGRAM

(71) Applicant: SEIKO EPSON CORPORATION, Tokyo (JP)

(72) Inventors: Mami Hashizume, Ina (JP); Hidetoshi Kodama, Matsumoto (JP); Tetsuji Takeishi, Shiojiri (JP); Toru Nakazawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/329,514

(22) Filed: May 25, 2021

(65) Prior Publication Data

US 2021/0370699 A1 Dec. 2, 2021

(30) Foreign Application Priority Data

May 26, 2020 (JP) ..... JP2020-091262

(51) Int. Cl.

| | |
|---|---|
| ***B65H 1/04*** | (2006.01) |
| ***B41J 29/12*** | (2006.01) |
| ***B41J 13/00*** | (2006.01) |
| ***B65H 1/26*** | (2006.01) |
| ***B65H 3/62*** | (2006.01) |
| ***B41J 29/02*** | (2006.01) |

(52) U.S. Cl.

CPC ..... *B41J 29/12* (2013.01); *B41J 13/0018* (2013.01); *B41J 29/02* (2013.01); *B65H 1/04* (2013.01); *B65H 1/266* (2013.01); *B65H 3/62* (2013.01); *B65H 2301/5115* (2013.01); *B65H 2405/111* (2013.01); *B65H 2405/112* (2013.01); *B65H 2405/113* (2013.01); *B65H 2405/114* (2013.01); *B65H 2405/14* (2013.01); *B65H 2515/50* (2013.01); *B65H 2601/2611* (2013.01); *B65H 2801/03* (2013.01)

(58) Field of Classification Search

CPC ..... B65H 2515/50; B65H 3/62; B65H 31/34; B65H 31/38; B65H 2405/114; B65H 2301/4222; B65H 1/04; B65H 2601/2611; B65H 2801/03

USPC ..... 271/171

See application file for complete search history.

(56) References Cited

U.S. PATENT DOCUMENTS

| | | | | |
|---|---|---|---|---|
| 4,325,544 A * | 4/1982 | Magno | B65H 31/38 271/223 |
| 7,588,249 B2 * | 9/2009 | Caron | B65H 1/06 271/223 |
| 10,071,875 B2 * | 9/2018 | Taki | B65H 37/04 |

FOREIGN PATENT DOCUMENTS

JP 2006021851 A 1/2006

* cited by examiner

*Primary Examiner* — Jeremy R Severson
(74) *Attorney, Agent, or Firm* — Chip Law Group

(57) ABSTRACT

A supply device configured to supply a medium to a processing unit configured to perform processing on the medium, the supply device including an accommodating unit configured to accommodate a plurality of the media in a state of being stacked therein and a vibration imparting unit configured to contact ends of the plurality of media accommodated in the accommodating unit to impart vibration to the medium.

18 Claims, 22 Drawing Sheets

SUPPLY DEVICE, PROCESSING DEVICE, CONTROL METHOD AND PROGRAM

The present application is based on, and claims priority from JP Application Serial Number 2020-091262, filed May 26, 2020, the disclosure of which is hereby incorporated by reference herein in its entirety.

BACKGROUND

1. Technical Field

The present disclosure relates to a supply device, a processing device, a control method, and a program, for example.

2. Related Art

JP-A-2006-021851 describes a supply device configured to supply a medium to a processing unit. The supply device includes an accommodating unit configured to accommodate a medium, and a blowing device configured to blow air onto the medium accommodated in the accommodating unit. The accommodating unit is configured to accommodate a plurality of the media in a state of being stacked therein. Dust is removed from the medium by the blowing device blowing air on the medium.

In the supply device described in JP-A-2006-021851, air is blown by the blowing device to a top medium on the plurality of media to be stacked. Therefore, while the dust is removed from the top medium of the plurality of media, the dust may be insufficiently removed from the other medium.

SUMMARY

A supply device for solving the above-described problems includes a supply device configured to supply a medium to a processing unit configured to perform processing on the medium, the supply device including an accommodating unit configured to accommodate a plurality of the media in a state of being stacked therein and a vibration imparting unit configured to contact ends of the plurality of media accommodated in the accommodating unit to impart vibration to the medium.

A processing device for solving the above-described problem includes the above-described supply device and the processing unit.

A control method for solving the above-described problems includes a control method for a supply device configured to supply a medium to a processing unit, the supply device including an accommodating unit configured to accommodate a plurality of the media in a state of being stacked therein and a vibration imparting unit configured to contact ends of the plurality of media accommodated in the accommodating unit to impart vibration to the medium, wherein the method includes imparting vibration to the medium by the vibration imparting unit when the medium is accommodated in the accommodating unit.

A program for solving the above-described problems includes a program for causing a control unit to execute control of a supply device configured to supply a medium to a processing unit, the supply device including an accommodating unit configured to accommodate a plurality of the media in a state of being stacked therein and a vibration imparting unit configured to contact ends of the plurality of media accommodated in the accommodating unit to impart vibration to the medium, wherein the program causes the vibration imparting unit to impart vibration to the medium when the medium is accommodated in the accommodating unit.

DESCRIPTION OF EXEMPLARY EMBODIMENTS

Hereinafter, an embodiment of a supply device will be described with reference to the accompanying drawings.

First Embodiment

A supply device of a first embodiment configures a processing device. The processing device includes, for example, an ink jet-type printer that prints an image such as characters and photographs on a medium such as a sheet by discharging ink, which is an example of a liquid.

Figure 1:
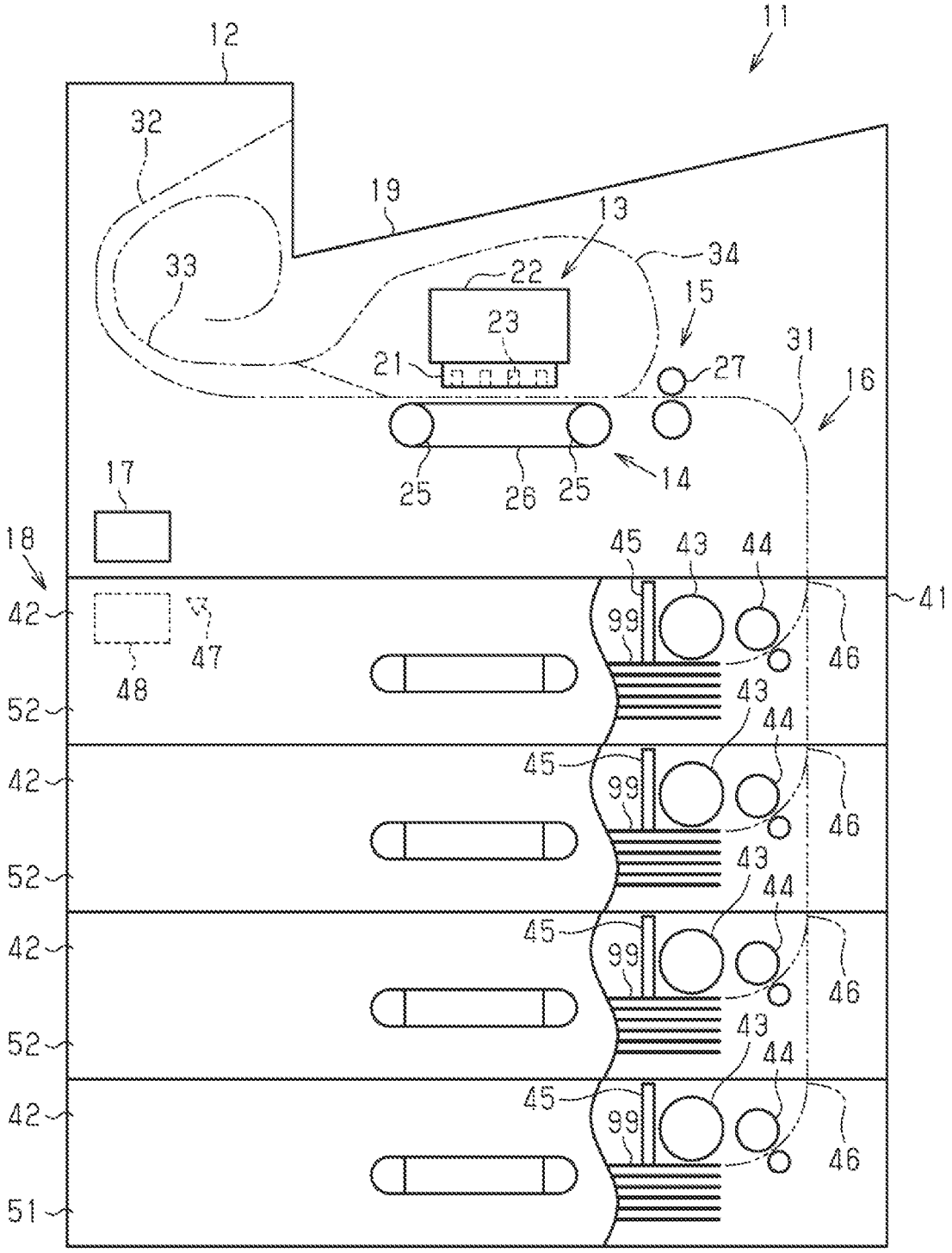
FIG. 1 is a front view schematically illustrating a processing device including a supply device according to a first embodiment.

As illustrated in FIG. 1, a processing device 11 includes a housing 12. The processing device 11 includes a processing unit 13, a support portion 14, a transport unit 15, a transport path 16, and a processing control unit 17. The processing device 11 of the first embodiment further includes a supply device 18.

The housing 12 accommodates various configurations of the processing device 11. The housing 12 has a loading surface 19. In the first embodiment, the loading surface 19 configures an upper surface of the housing 12. A medium 99 is processed to be loaded on the loading surface 19.

The processing unit 13 is configured to perform processing on the medium 99. The processing unit 13 of the first embodiment performs processing on the medium 99 by performing printing on the medium 99. The processing unit 13 of the first embodiment includes a head 21 and a holder 22.

The head 21 is held by the holder 22. The head 21 has one or more nozzles 23. The head 21 performs printing onto the medium 99 by discharging liquid from the nozzles 23. The head 21 of the first embodiment is a line head capable of discharging liquid simultaneously across the width of the medium 99. The head 21 may be a serial head that performs scanning with respect to the medium 99.

The support portion 14 is located at a position facing the processing unit 13. The support portion 14 supports the medium 99. The processing unit 13 and the support portion 14 are located so as to sandwich a portion of the transport path 16. The processing unit 13 performs processing on the medium 99 supported by the support portion 14.

The support portion 14 of the first embodiment has a pair of rollers 25 and a belt 26. The belt 26 is wound onto a pair of the rollers 25. Rotation of the rollers 25 causes the belt 26 to orbit along the circumference of the rollers 25. The support portion 14 supports the medium 99 by the outer circumferential surface of the belt 26. The support portion 14 of the first embodiment supports the medium 99 and transports the medium 99. The support portion 14 may be configured as a support table for simply supporting the medium 99 without transporting the medium 99.

The transport unit 15 is configured to transport the medium 99. In the first embodiment, the transport unit 15 transports the medium 99 along the transport path 16. The transport unit 15 has one or more transport rollers 27, for example. The transport rollers 27 are located along the transport path 16. The transport rollers 27 transport the medium 99 by rotating in contact with the medium 99.

The transport path 16 is a path where the medium 99 is transported. The transport path 16 of the first embodiment is a path through which the transport unit 15 transports the medium 99. The transport path 16 of the first embodiment extends within the housing 12 as illustrated by the two-dot chain line in FIG. 1. In the first embodiment, the transport path 16 includes a supply path 31, an ejection path 32, a switchback path 33, and an inversion path 34.

The supply path 31 is a path to which the medium 99 is supplied to the processing unit 13. As such, the supply path 31 extends from the supply device 18 toward the processing unit 13.

The ejection path 32 is a path through which the processed medium 99 is ejected. In the first embodiment, the ejection path 32 is a path through which the medium 99 processed by the processing unit 13 is ejected to the loading surface 19. The ejection path 32 extends from the processing unit 13 toward the upper portion of the loading surface 19. The medium 99 transported through the ejection path 32 is ejected out of the housing 12. The ejected medium 99 falls to be loaded on the loading surface 19.

The switchback path 33 is a path where the medium 99 is switched back. In the first embodiment, for example, the medium 99 printed on one side thereof is transported through the switchback path 33. When the medium 99 is switched back in the switchback path 33, the transport orientation of the medium 99 is reversed. In the first embodiment, the switchback path 33 extends from the ejection path 32 and extends along the ejection path 32. The termination of the switchback path 33 fits within the housing 12, unlike the ejection path 32.

The inversion path 34 is a path where the posture of the medium 99 is inverted. In the first embodiment, the medium 99 transported through the switchback path 33 is transported. The inversion path 34 branches from the switchback path 33 and extends toward the supply path 31. The inversion path 34 extends through the upper portion of the processing unit 13. By transporting the medium 99 through the inversion path 34, the posture of the medium 99 is reversed. In the first embodiment, when the medium 99 is transported through the inversion path 34, the posture of the medium 99 is reversed vertically.

The switchback path 33 and the inversion path 34 are used, for example, when performing printing on both sides of the medium 99. By being transported through the switchback path 33 and the inversion path 34, the medium 99 is transported toward the processing unit 13 again with the printed surface facing the support portion 14. In other words, the medium 99 is transported with the unprinted surface thereof facing the processing unit 13. This causes the processing device 11 to perform printing on both sides of the medium 99.

The processing control unit 17 is a control unit that controls various configurations of the processing device 11. The processing control unit 17 can be configured as a circuit including a: one or more processors that execute various processing according to a computer program, one or more dedicated hardware circuits such as an application specific integrated circuit that executes at least a part of various processing, or y: a combination thereof. The processor includes a CPU and a memory such as a RAM and a ROM. The memory stores a program code or a command configured to cause the CPU to execute the processing. The memory, or a computer readable medium includes any medium accessible by a general purpose or special purpose computer.

The supply device 18 is a device that supplies the medium 99 to the processing unit 13. In the first embodiment, the supply device 18 is embedded in the processing device 11, but may also be externally attached to the processing device 11. In the first embodiment, the supply device 18 is located below the processing device 11. The supply device 18 is located below the processing unit 13, for example.

The supply device 18 includes a housing 41, a cassette 42, a pickup roller 43, a separation roller 44, a clamping member 45, a delivery path 46, a sensor 47, and a supply control unit 48.

The housing 41 is configured so that the cassette 42 can be mounted thereto. In the first embodiment, the housing 41 of the supply device 18 is integrally configured with the housing 12 of the processing device 11, but may also be configured as a separate body.

One or more cassettes 42 are provided. In the first embodiment, four cassettes 42 are provided. The four cassettes 42 are provided so as to be stacked vertically.

The cassettes 42 is configured to accommodate the medium 99. Specifically, the cassettes 42 each accommodate a plurality of the media 99 in a stacked state. In this regard, the cassettes 42 are an accommodating unit that accommodates the medium 99. The medium 99 accommodated in the cassettes 42 is, for example, sheet-like and rectangular. The medium 99 is not limited to paper, and may be a fabric or a plastic film. The cassettes 42 of the first embodiment each accommodates the plurality of media 99 in landscape orientation.

Figure 2:
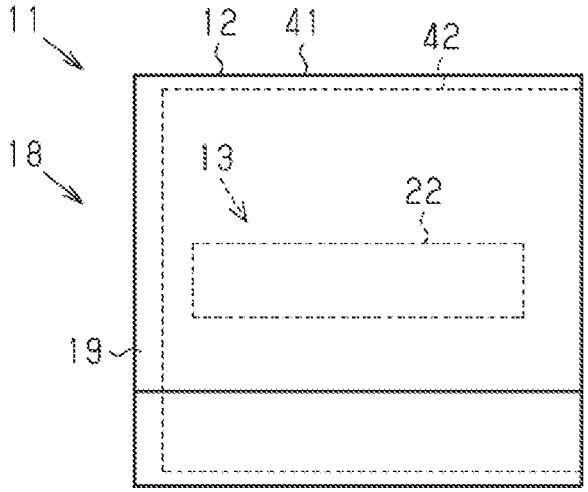
FIG. 2 is a plan view of the processing device.

As illustrated in FIG. 2, in the first embodiment, the cassettes 42 vertically overlaps the processing unit 13. The "vertically" indicates a direction orthogonal to an installation surface at which the processing device 11 is installed, for example. The cassettes 42 are detachable relative to the housing 41. The cassettes 42 accommodating the medium 99 are mounted to the housing 41, whereby the supply device 18 can supply the medium 99 toward the processing unit 13. A detailed configuration of the cassettes 42 will be described later.

As illustrated in FIG. 1, the pickup roller 43 is provided in the housing 41. The pickup roller 43 is a roller that picks up the medium 99 accommodated in the cassettes 42. As such, the pickup roller 43 is provided for each cassette 42. The pickup roller 43 contacts the top medium 99 of the plurality of media 99 accommodated in the cassette 42. At this time, the pickup roller 43 clamps the medium 99 from above. In this regard, the pickup roller 43 is a clamping unit that clamps the medium 99. The pickup roller 43 rotates while clamping the medium 99, to feed the top medium 99.

The separation roller 44 is provided in the housing 41. The separation roller 44 is a roller that separates the medium 99 fed by the pickup roller 43 one by one. As such, the pickup roller 43 is provided for each cassette 42. The separation roller 44 separates the medium 99 fed by the pickup roller 43 one by one, for example, by the friction force thereof.

The clamping member 45 is provided in the housing 41. The clamping member 45 is a member for clamping the medium 99 accommodated in the cassette 42. The clamping member 45 clamps the medium 99 accommodated in the cassette 42 from above. In this regard, the clamping member 45 is a clamping unit that clamps the medium 99. The clamping member 45 clamps the medium 99 to hold the medium 99 in the cassette 42.

The clamping member 45 is configured to be vertically displaced. As a result, the clamping member 45 rises and falls. The clamping member 45 contacts, by being displaced downward, the top medium 99 of the medium 99 accommodated in the cassette 42. At this time, the clamping member 45 clamps the medium 99. The clamping member 45 is displaced upward, thereby preventing contact with the medium 99 accommodated in the cassette 42.

The clamping member 45 is, for example, a plate-like member. The clamping member 45 is formed of a material having a relatively small coefficient of friction with respect to the medium 99. Specifically, the coefficient of friction of the clamping member 45 with respect to the medium 99 is smaller than the coefficient of friction of the pickup roller 43 with respect to the medium 99. In the first embodiment, the clamping member 45 is formed of POM. The POM is a polyacetal resin. As a result, the clamping member 45 can clamp the medium 99 while reducing the load applied to the medium 99. In addition, even when the clamping member 45 clamps the medium 99, the pickup roller 43 can feed the medium 99.

Figure 3:
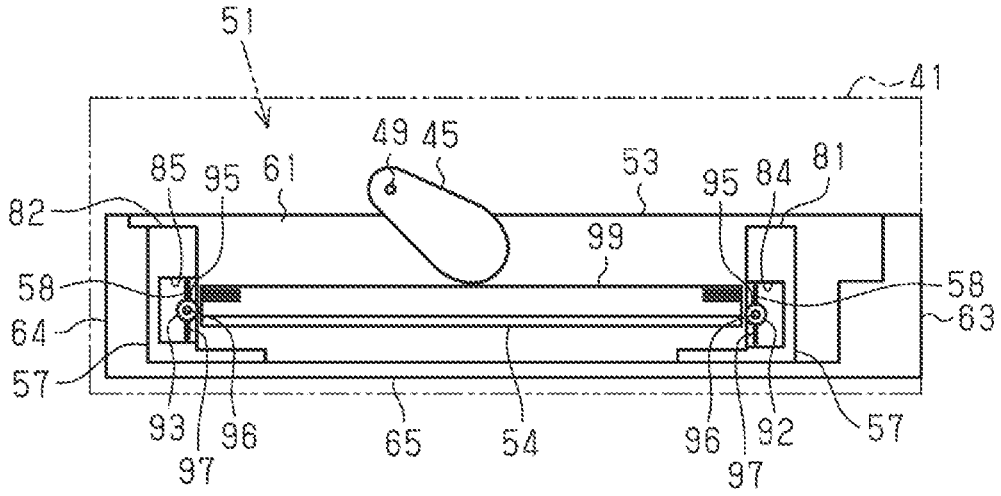
FIG. 3 is a cross-sectional view of a removal cassette.
Figure 4:
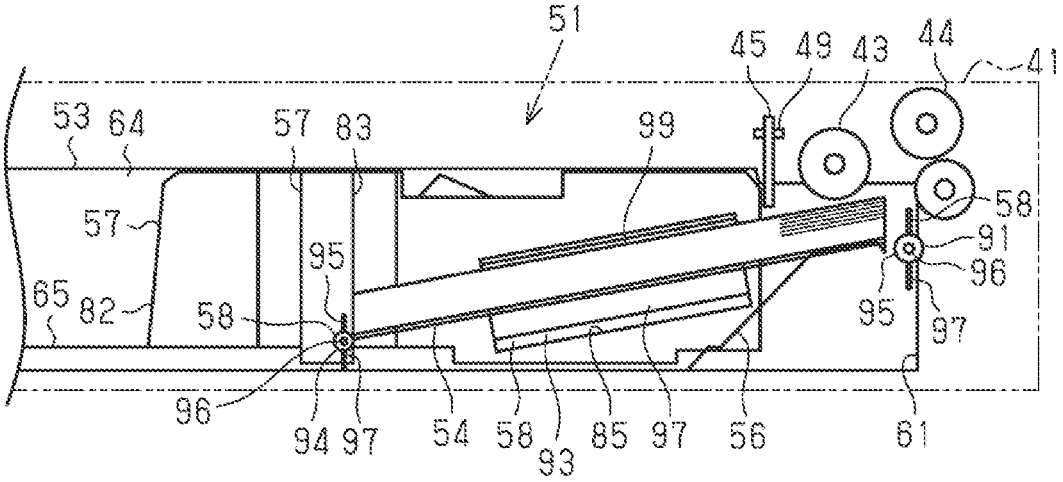
FIG. 4 is a cross-sectional view of the removal cassette being cut at a different location than in FIG. 3.
Figure 5:
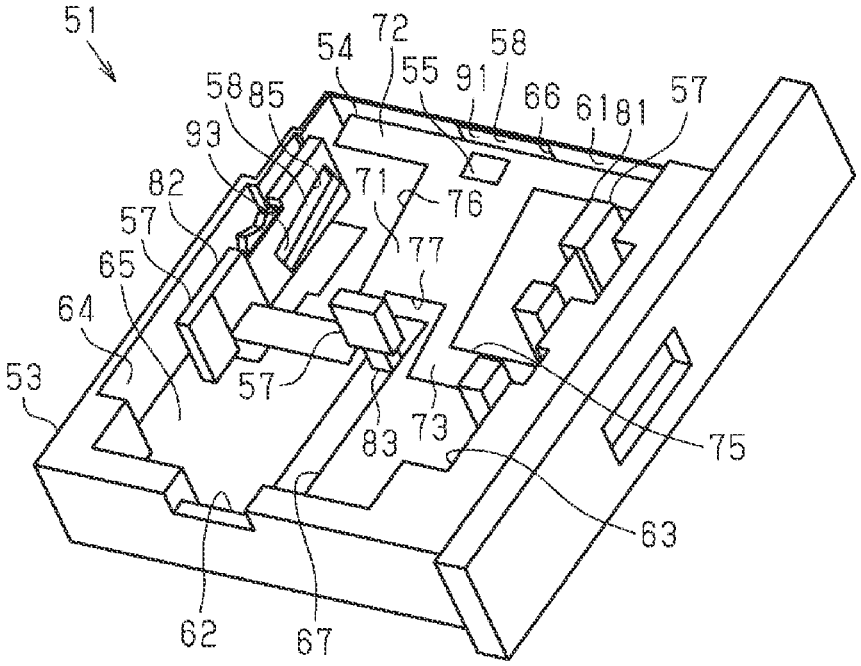
FIG. 5 is a perspective view of the removal cassette.
Figure 6:
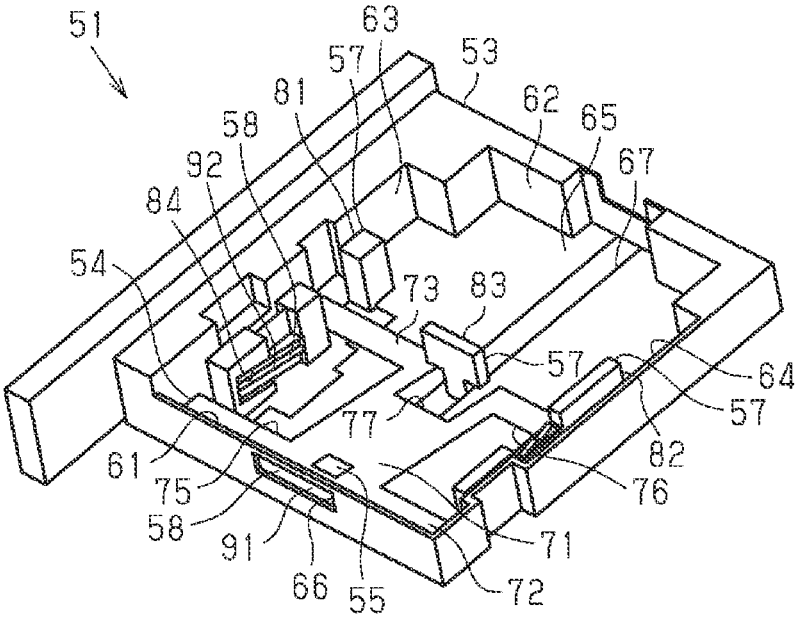
FIG. 6 is a perspective view of the removal cassette viewed from a different angle than in FIG. 5.
Figure 7:
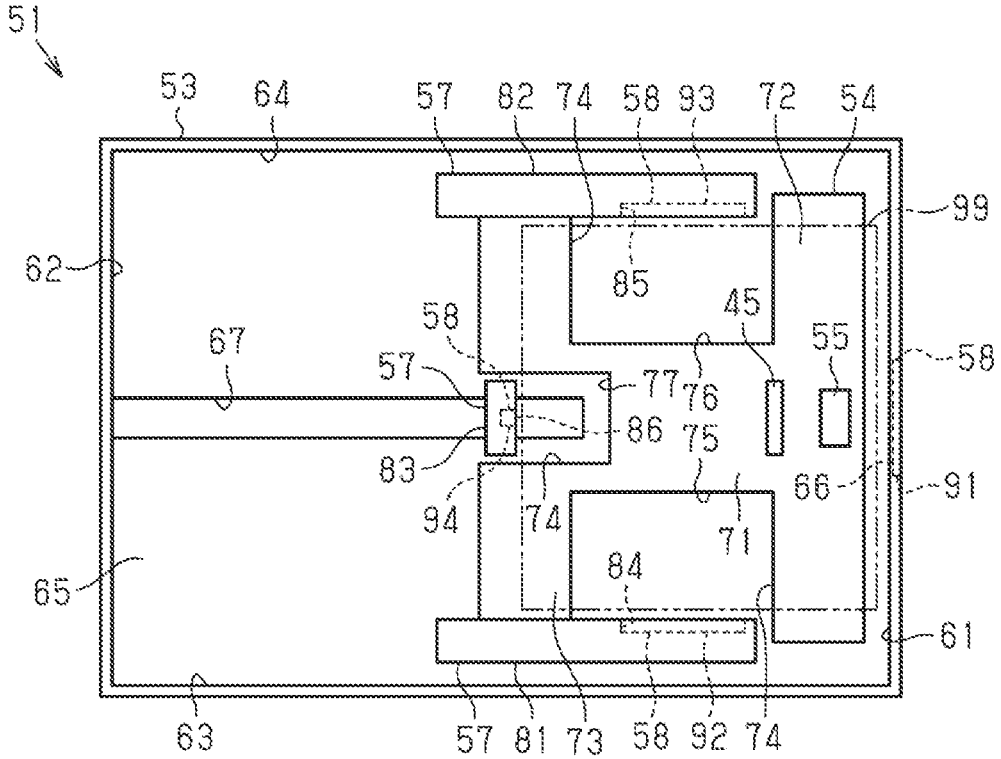
FIG. 7 is a plan view of the removal cassette.

As illustrated in FIGS. 3 and 4, the clamping member 45 has a shaft 49. The clamping member 45 rotates about the shaft 49. The shaft 49 is provided to one end of the clamping member 45. The clamping member 45 is attached to the housing 41 by the shaft 49.

When the clamping member 45 rotates about the shaft 49, the other end of the clamping member 45 is vertically displaced, i.e., rises and falls. In this manner, the clamping member 45 rises and falls by rotating about the shaft 49. As a result, the other end of the clamping member 45 contacts the medium 99. The clamping member 45 may be configured to move upward and downward by sliding vertically, without being limited to the rotation.

As illustrated in FIG. 1, the delivery path 46 is a path through which the medium 99 is fed by the pickup roller 43 and the separation roller 44. As such, the delivery path 46 is provided for each cassette 42. The delivery path 46 is provided in the housing 41. One delivery path 46 connects another delivery path 46 corresponding to the cassette 42 adjacent to the cassette 42 corresponding the one delivery path 46. That is, each of a plurality of the delivery paths 46 is coupled to one another.

Among the plurality of delivery paths 46, the delivery path 46 corresponding to the top cassette 42 is coupled to the supply path 31. As such, the medium 99 accommodated in the cassette 42 is transported to the transport path 16 through the delivery path 46. Further, since each of the delivery paths 46 is coupled to one another, the medium 99 can be fed between the plurality of cassettes 42. For example, the medium 99 accommodated by the bottommost cassette 42 may be fed through the delivery path 46 toward the other cassette 42. For example, the medium 99 accommodated by the top cassette 42 may be fed through the delivery path 46 toward the other cassette 42.

The sensor 47 is configured to detect that the cassette 42 has been mounted to the housing 41. In this regard, the sensor 47 is a detecting unit that detects that the cassette 42 has been mounted to the housing 41. The sensor 47 is an optical sensor, for example. The sensor 47 of the first embodiment sends a signal to the supply control unit 48 when the cassette 42 is mounted to the housing 41.

The supply control unit 48 is a control unit that controls various configurations of the supply device 18. The supply control unit 48 communicates with the processing control unit 17. As with the processing control unit 17, the supply control unit 48 can be configured as a circuit including a: one or more processors that execute various processing according to a computer program, one or more dedicated hardware circuits such as an application specific integrated circuit that executes at least a part of various processing, or y: a combination thereof. The processor includes a CPU and a memory such as a RAM and a ROM. The memory stores a program code or a command configured to cause the CPU to execute the processing. The memory, or a computer readable medium includes any medium accessible by a general purpose or special purpose computer.

Next, the cassettes 42 will be described in detail. The cassettes 42 includes a removal cassette 51. In the first embodiment, the cassettes 42 includes one or more removal cassettes 51 and one or more normal cassettes 52. That is, the accommodating unit corresponding to the cassettes 42 includes a first accommodating unit that is the removal cassette 51 and a second accommodating unit that is the normal cassette 52.

In the first embodiment, one removal cassette 51 is provided, and three normal cassettes 52 are provided. In the supply device 18, the one removal cassette 51 and the three normal cassettes 52 are arranged to be stacked vertically. In the first embodiment, the removal cassette 51 is located below the normal cassettes 52. Thus, the removal cassette 51 is located at the bottommost row of the plurality of cassettes 42.

Next, the configuration of the removal cassette 51 will be described in detail. The removal cassette 51 is different from the normal cassette 52 in that the removal cassette 51 includes a configuration that imparts vibration to the accommodated medium 99, and other configurations are the same. The configuration that imparts vibration to the medium 99 is, for example, a vibration imparting unit described below. Accordingly, configurations other than the configuration that imparts vibration to the medium 99 are also included in the removal cassette 51 as well as the normal cassette 52.

As illustrated in FIGS. 3, 4, 5, 6 and 7, the removal cassette 51 has an accommodating body 53, a hopper 54, an ultrasonic element 55, a lifting member 56, an edge guide 57, and a rotating body 58.

The accommodating body 53 is a case that accommodates the medium 99. The accommodating body 53 has a first wall 61, a second wall 62, a third wall 63, a fourth wall 64, and a bottom wall 65.

The first wall 61, the second wall 62, the third wall 63, and the fourth wall 64 extend from the bottom wall 65. The first wall 61, the second wall 62, the third wall 63, and the fourth wall 64 are located so as to surround the medium 99 accommodated in the accommodating body 53.

The first wall 61 faces the second wall 62. The first wall 61 interfaces with the third wall 63 and the fourth wall 64. In the first embodiment, the first wall 61 faces a tip of the medium 99 accommodated in the accommodating body 53. The tip of the medium 99 is a leading end thereof when the medium 99 is fed out.

The first wall 61 has a first accommodation port 66 that accommodates the rotating body 58. The first accommodation port 66 is an accommodation port included in the first wall 61. The accommodation port is an opening that accommodates the rotating body 58. The first accommodating port 66 of the first embodiment passes through the first wall 61.

The second wall 62 faces the first wall 61. The second wall 62 interfaces with the third wall 63 and the fourth wall 64. In the first embodiment, the second wall 62 faces a back end of the medium 99 accommodated in the accommodating body 53. The back end of the medium 99 is an end opposite the tip.

The third wall 63 faces the fourth wall 64. The third wall 63 interfaces with the first wall 61 and the second wall 62. In the first embodiment, the third wall 63 faces a side end of the medium 99 accommodated in the accommodating body 53. The side end of the medium 99 is a different end than the tip and the back end.

The fourth wall 64 faces the third wall 63. The fourth wall 64 interfaces with the first wall 61 and the second wall 62. In the first embodiment, the fourth wall 64 faces the side end of the medium 99 accommodated in the accommodating body 53. The side end of the medium 99 to which the fourth wall 64 faces is an end opposite to the side end of the medium 99 with which the third wall 63 faces.

The bottom wall 65 is a wall that configure the bottom of the accommodating body 53. A groove 67 is provided at the bottom wall 65. The groove 67 extends from the second wall 62 toward the first wall 61.

In the first embodiment, the medium 99 accommodated in the removal cassette 51 is fed out from the second wall 62 in a direction toward the first wall 61. In the first embodiment, the removal cassette 51 is mounted to the housing 41 by moving in a direction from the third wall 63 toward the fourth wall 64. Conversely, the removal cassette 51 is removed from the housing 41 by moving in a direction from the fourth wall 64 toward the third wall 63.

The hopper 54 is provided in the accommodating body 53. The hopper 54 is provided, for example, in a flat plate shape. The hopper 54 supports, from below, the medium 99 accommodated by the accommodating body 53. In other words, the medium 99 is placed at the hopper 54.

The hopper 54 is vertically displaced by the lifting member 56. That is, the hopper 54 rises and falls. The hopper 54 is displaced between a position along the bottom wall 65 and a position that is pushed upward by the lifting member 56.

The hopper 54 is located at the position that is pushed upward by the lifting member 56. When the hopper 54 is pushed up by the lifting member 56, the medium 99 placed at the hopper 54 is pushed upward. As a result, the medium 99 placed at the hopper 54 is pressed against the pickup roller 43. When the clamping member 45 is displaced downward, the medium 99 placed at the hopper 54 is also pressed against the clamping member 45. The pickup roller 43 and the clamping member 45 contact the medium 99 at a position where the pickup roller 43 and the clamping member 45 overlap the hopper 54 when the removal cassette 51 is viewed in plan view.

The hopper 54 is linked to the attachment and detachment of the cassette 42, for example. The hopper 54 is displaced into the pushed-up position by mounting the removal cassette 51 to the housing 41. That is, when the removal cassette 51 is mounted to the housing 41, the lifting member 56 pushes up the hopper 54. The hopper 54 is displaced to a position along the bottom wall 65 by removing the removal cassette 51 from the housing 41. The hopper 54 may be configured to move upward and downward at a desired timing, without being linked to the attachment and detachment of the cassette 42.

The hopper 54 has an upper surface 71, a tip portion 72, a back end portion 73, and notches 74.

The upper surface 71 is a surface at which the medium 99 is placed. In this regard, the upper surface 71 is a placement surface at which the medium 99 is placed. The upper surface 71 is located above the bottom wall 65.

The tip portion 72 is a portion where the medium 99 is pressed against the pickup roller 43 by the hopper 54 being pushed up onto the lifting member 56. As such, the tip portion 72 is a portion located below the pickup roller 43 in the hopper 54. The tip portion 72 is closer to the first wall 61 than the back end portion 73. That is, the distance between the tip portion 72 and the first wall 61 is shorter than the distance between the back end portion 73 and the first wall 61.

The back end portion 73 is a portion that is an end opposite to the tip portion 72. As such, the back end portion 73 is closer to the second wall 62 than the tip portion 72. That is, the distance between the back end portion 73 and the second wall 62 is shorter than the distance between the tip portion 72 and the second wall 62.

The back end portion 73 is attached to the bottom wall 65. The hopper 54 is configured to rotate about the back end portion 73 as a fulcrum. The rotation of the hopper 54 about the back end portion 73 displaces the tip portion 72 vertically. As a result, the medium 99 placed at the hopper 54 is pushed up. The hopper 54 is in a posture of extending upward from the back end portion 73 to the tip portion 72 while pushing up the medium 99.

A notch 74 is provided by cutting out a portion of the hopper 54. The notch 74 is provided so as to cut out a portion corresponding to the edge guide 57. Therefore, the notch 74 is provided so as to correspond to the edge guide 57.

One or more notches 74 are provided. In the first embodiment, three notches 74 are provided. Thus, in the first embodiment, the notches 74 includes a first notch 75, a second notch 76, and a third notch 77.

The first notch 75 and the second notch 76 are provided so as to cut out both side ends of the hopper 54. Both side ends of the hopper 54 are two ends, excluding the tip and the back end. Both side ends of the hopper 54 include a side end facing the third wall 63 and a side end facing the fourth wall 64.

The first notch 75 and the second notch 76 are provided so as to cut out a portion between the tip portion 72 and the back end portion 73. The first notch 75 and the second notch 76 cause the hopper 54 to have a shape of H when the hopper 54 is viewed from above.

The third notch 77 is provided to cut out the back end portion 73. The third notch 77 is provided to cut out a central portion of the back end portion 73. The central portion of the back end portion 73 is a central portion between the third wall 63 and the fourth wall 64 at the back end portion 73.

The ultrasonic element 55 is an element that operates to generate ultrasonic waves. The ultrasonic element 55 operates, for example, by applying a voltage. The ultrasonic element 55 is provided in the hopper 54. The ultrasonic element 55 is provided to the upper surface 71 of the hopper 54. The ultrasonic element 55 is provided at the tip portion 72. The ultrasonic element 55 imparts vibration to the medium 99 placed at the hopper 54 by generating ultrasonic waves. In the first embodiment, in addition to the vibration imparting unit described below, the ultrasonic element 55 is provided only in the removal cassette 51 and is not provided in the normal cassette 52. The ultrasonic element 55 operates, for example, when the vibration imparting unit imparts vibration to the medium 99.

The lifting member 56 is a member that raises and lowers the hopper 54. The lifting member 56 is provided below the hopper 54. One end of the lifting member 56 is attached to the hopper 54, and the other end opposite to the one end is attached to the bottom wall 65. The lifting member 56 is configured to be rotatable about the other end thereof as a fulcrum. As a result of the lifting member 56 rotating about the other end thereof as a fulcrum, the one end of the lifting member 56 is vertically displaced. As a result, the hopper 54 is vertically displaced, i.e., rises and falls.

The lifting member 56 may vibrate with the hopper 54 being pushed up. In this case, the vibration of the lifting member 56 causes the hopper 54 to vibrate. This imparts vibration to the medium 99 placed at the hopper 54. The lifting member 56 may vibrate, for example, when the vibration imparting unit described below imparts vibration to the medium 99.

The edge guide 57 is a member that contacts the plurality of media 99 to align the position of the plurality of media 99. The edge guide 57 contacts the end of the plurality of media 99 placed at the hopper 54 to align the position of the end of the medium 99 placed at the hopper 54. In this regard, the edge guide 57 is an alignment unit that aligns the medium 99.

One or more edge guides 57 are provided. In the first embodiment, three edge guides 57 are provided. Thus, in the first embodiment, the edge guides 57 includes a first edge guide 81, a second edge guide 82, and a third edge guide 83.

The first edge guide 81 is provided to the bottom wall 65. The first edge guide 81 is configured to be movable over the bottom wall 65. The first edge guide 81 is movable in a direction from the third wall 63 toward the fourth wall 64 and a direction from the fourth wall 64 toward the third wall 63.

The first edge guide 81 is an edge guide 57 that contacts the side end of the medium 99 placed at the hopper 54. The first edge guide 81 contacts the side end of the medium 99 by moving closer to the fourth wall 64. The first edge guide 81 moves closer to the fourth wall 64, thereby entering the first notch 75. In this regard, the first edge guide 81 corresponds to the first notch 75.

Figure 8:
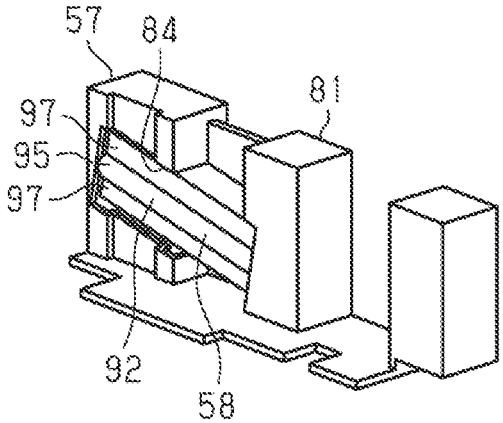
FIG. 8 is a perspective view of a first edge guide.

As illustrated in FIG. 8, the first edge guide 81 has a second accommodation port 84 that accommodates the rotating body 58. The second accommodation port 84 is an accommodation port included in the first edge guide 81. The second accommodation port 84 faces inward of the accommodating body 53. In other words, the second accommodation port 84 faces the fourth wall 64.

As illustrated in FIGS. 3, 4, 5, 6, and 7, the second edge guide 82 is provided to the bottom wall 65. The second edge guide 82 is configured to be movable over the bottom wall 65. The second edge guide 82 is movable in a direction from the third wall 63 toward the fourth wall 64 and a direction from the fourth wall 64 toward the third wall 63.

The second edge guide 82 is an edge guide 57 that contacts the side end of the medium 99 placed at the hopper 54. The second edge guide 82 moves closer to the third wall 63 so as to contact a side end that is opposite to the side end of the medium 99 with which the first edge guide 81 comes into contact. The second edge guide 82 moves closer to the third wall 63, thereby entering the second notch 76. In this regard, the second edge guide 82 corresponds to the second notch 76.

In the first embodiment, the second edge guide 82 is linked to first edge guide 81. In other words, the first edge guide 81 and the second edge guide 82 are linked to each other. For example, when the first edge guide 81 moves closer to the third wall 63, the second edge guide 82 moves closer to the fourth wall 64. At this time, the distance between the first edge guide 81 and the second edge guide 82 is increased. For example, when the first edge guide 81 moves closer to the fourth wall 64, the second edge guide 82 moves closer to the third wall 63. At this time, the distance between the first edge guide 81 and the second edge guide 82 is shortened. As a result, the medium 99 placed at the hopper 54 is sandwiched between the first edge guide 81 and the second edge guide 82. By bringing the first edge guide 81 and the second edge guide 82 into contact with both side ends of the medium 99, the positions of both side ends of the medium 99 are aligned.

Figure 9:
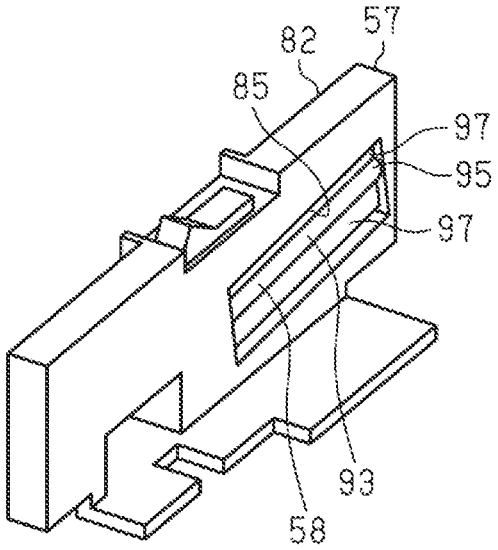
FIG. 9 is a perspective view of a second edge guide.

As illustrated in FIG. 9, the second edge guide 82 has a third accommodation port 85 that accommodates the rotating body 58. The third accommodation port 85 is an accommodation port included in the second edge guide 82. The third accommodation port 85 faces inward of the accommodating body 53. In other words, the third accommodation port 85 faces the third wall 63.

As illustrated in FIGS. 3, 4, 5, 6, and 7, the third edge guide 83 is provided to the bottom wall 65. The third edge guide 83 is configured to be movable over the bottom wall 65. In the first embodiment, the third edge guide 83 is provided so as to fit in the groove 67. The third edge guide 83 moves along the groove 67 over the bottom wall 65. That is, the groove 67 is a path of the third edge guide 83. The third edge guide 83 is movable along the groove 67 in a direction from the first wall 61 toward the second wall 62 and a direction from the second wall 62 toward the first wall 61.

The third edge guide 83 is an edge guide 57 that moves to come into contact with the back end of the medium 99 placed at the hopper 54. The third edge guide 83 moves closer to the first wall 61 to contact the back end of the medium 99. The third edge guide 83 moves closer to the first wall 61, thereby entering the third notch 77. In this regard, the third edge guide 83 corresponds to the third notch 77.

The third edge guide 83 contacts the back end of the medium 99 placed at the hopper 54 to receive the load of the medium 99. With the hopper 54 pushing up the medium 99, the medium 99 placed at the hopper 54 slides down on the hopper 54 from the tip portion 72 toward the back end portion 73 by the action of gravity. As a result, the medium 99 placed at the hopper 54 hits the third edge guide 83. At this time, the third edge guide 83 receives the load of the medium 99. Since the third edge guide 83 receives the load of the medium 99, the position of the back end of the medium 99 is aligned by the third edge guide 83, and the position of the tip of the medium 99 is aligned. As described above, the medium 99 is aligned by the first edge guide 81, the second edge guide 82, and the third edge guide 83.

Figure 10:
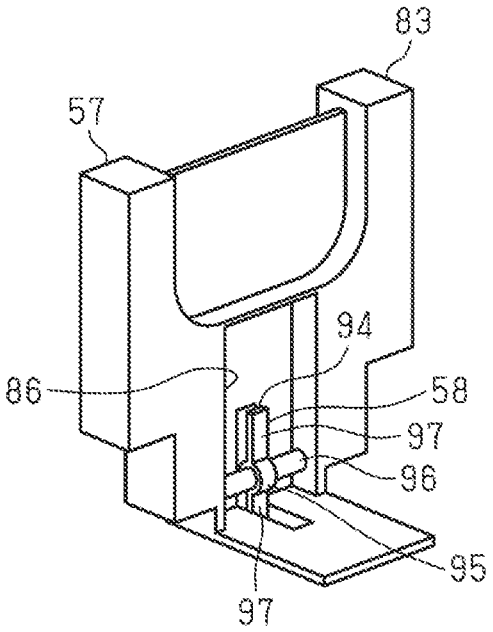
FIG. 10 is a perspective view of a third edge guide.
Figure 11:
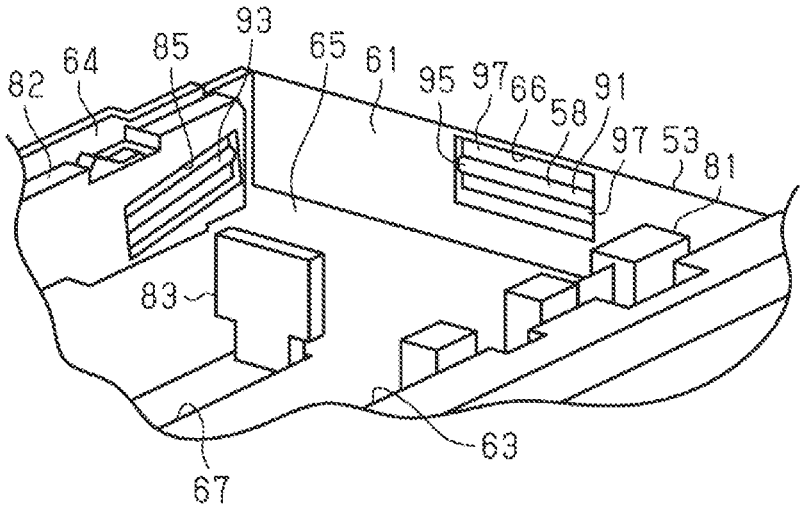
FIG. 11 is a perspective view of a first wall.

As illustrated in FIG. 10, the third edge guide 83 has a fourth accommodation port 86 that accommodates the rotating body 58. The fourth accommodation port 86 is an accommodation port included in the third edge guide 83. The fourth accommodation port 86 faces the first wall 61.

The edge guides 57 are operated by a user, for example. The user aligns the medium 99 by manipulating the edge guides 57 such that the edge guides 57 contact the ends of the medium 99 when the medium 99 is set in the accommodating body 53. That is, in the first embodiment, the medium 99 is manually aligned. The edge guides 57 may operate by being controlled by the supply control unit 48. That is, the medium 99 may be automatically aligned.

As illustrated in FIGS. 7, 8, 9, 10, and 11, the rotating body 58 is a rotating member. One or more rotating bodies 58 are provided. In the first embodiment, four rotating bodies 58 are provided. Thus, in the first embodiment, the rotating bodies 58 includes a first rotating body 91, a second rotating body 92, a third rotating body 93, and a fourth rotating body 94.

The first rotating body 91, the second rotating body 92, the third rotating body 93, and the fourth rotating body 94 are each accommodated in the four respective accommodation ports. Each of the first rotating body 91, the second rotating body 92, the third rotating body 93, and the fourth rotating body 94 contacts respective different ends of the medium 99.

The first rotating body 91, the second rotating body 92, the third rotating body 93, and the fourth rotating body 94 are provided so as to be vertically displaced, i.e., move upward and downward. The first rotating body 91, the second rotating body 92, the third rotating body 93, and the fourth rotating body 94 are each provided so as to move upward and downward within the respective accommodation port. The first rotating body 91, the second rotating body 92, the third rotating body 93, and the fourth rotating body 94 move upward and downward while rotating.

The first rotating body 91 is a rotating body 58 accommodated in the first accommodation port 66. As such, the first rotating body 91 is provided to the first wall 61. The first rotating body 91 is rotated to contact the plurality of media 99 placed at the hopper 54. The first rotating body 91 contacts the tip of the medium 99, for example, by rotating with the hopper 54 pushing up the medium 99. When the hopper 54 is viewed in plan view, the first rotating body 91 contacts the tip of the medium 99 that pops out of the tip portion 72 of the hopper 54. In other words, when the hopper 54 is viewed in plan view, the first rotating body 91 contacts a portion of the tip of the medium 99 that does not overlap the hopper 54.

The second rotating body 92 is a rotating body 58 accommodated in the second accommodation port 84. Thus, the second rotating body 92 is provided to the first edge guide 81. The second rotating body 92 moves with the second edge guide 82.

The second rotating body 92 is rotated to contact the plurality of media 99 placed at the hopper 54. The second rotating body 92 contacts the side end of the medium 99, for example, by rotating with the second edge guide 82 contacting the side end of the medium 99. When the hopper 54 is viewed in plan view, the second rotating body 92 contacts a portion of the medium 99 corresponding to the first notch 75. In other words, when the hopper 54 is viewed in plan view, the second rotating body 92 contacts a portion of the side end of the medium 99 that does not overlap the hopper 54.

The third rotating body 93 is a rotating body 58 accommodated in the third accommodation port 85. Therefore, the third rotating body 93 is provided to the second edge guide 82. The third rotating body 93 moves with the third edge guide 83.

The third rotating body 93 is rotated to contact the plurality of media 99 placed at the hopper 54. The third rotating body 93 contacts the side end, which is opposite to the side end of the medium 99 with which the second rotating body 92 comes into contact, for example, by rotating with the third edge guide 83 contacting the side end of the medium 99. When the hopper 54 is viewed in plan view, the third rotating body 93 contacts a portion of the medium 99 corresponding to the second notch 76. In other words, when the hopper 54 is viewed in plan view, the third rotating body 93 contacts a portion of the side end of the medium 99 that does not overlap the hopper 54.

The fourth rotating body 94 is a rotating body 58 accommodated in the fourth accommodation port 86. Thus, the fourth rotating body 94 is provided to the third edge guide 83. The fourth rotating body 94 moves with the third edge guide 83.

The fourth rotating body 94 is rotated to contact the plurality of media 99 placed at the hopper 54. The fourth rotating body 94 contacts the back end of the medium 99, for example, by rotating with the third edge guide 83 contacting the back end of the medium 99. When the hopper 54 is viewed in plan view, the fourth rotating body 94 contacts a portion of the medium 99 corresponding to the third notch 77. In other words, when the hopper 54 is viewed in plan view, the fourth rotating body 94 contacts a portion of the back end of the medium 99 that does not overlap the hopper 54.

The first rotating body 91, the second rotating body 92, the third rotating body 93, and the fourth rotating body 94 have different sizes, while each has a similar configuration. Thus, the configuration of the first rotating body 91, the second rotating body 92, the third rotating body 93, and the fourth rotating body 94 will be described collectively as the rotating bodies 58.

As illustrated in FIGS. 3 and 4, each of the rotating bodies 58 includes a rotating member 95 and a rotary shaft 96. The rotating member 95 rotates about the rotary shaft 96. The rotating member 95 has a vane 97. The vane 97 is formed from a material having elasticity such as rubber, elastomer, etc. The vane 97 extends outwardly in the rotating member 95. That is, the vane 97 extends radially around the rotary shaft 96. In other words, the vane 97 may be configured by a member configured of a material having elasticity, with a plurality of elongated members being arranged such that one end thereof is fixed to the rotary shaft 96 and the other end is located on the circumference of the circle centered on the rotary shaft 96.

The rotary shaft 96 extends in a direction along the upper surface 71 of the hopper 54. In particular, the rotary shaft 96 of the second rotating body 92 and the rotary shaft 96 of the third rotating body 93 extend in a direction along the upper surface 71 with the hopper 54 being pushed up.

Figure 12:
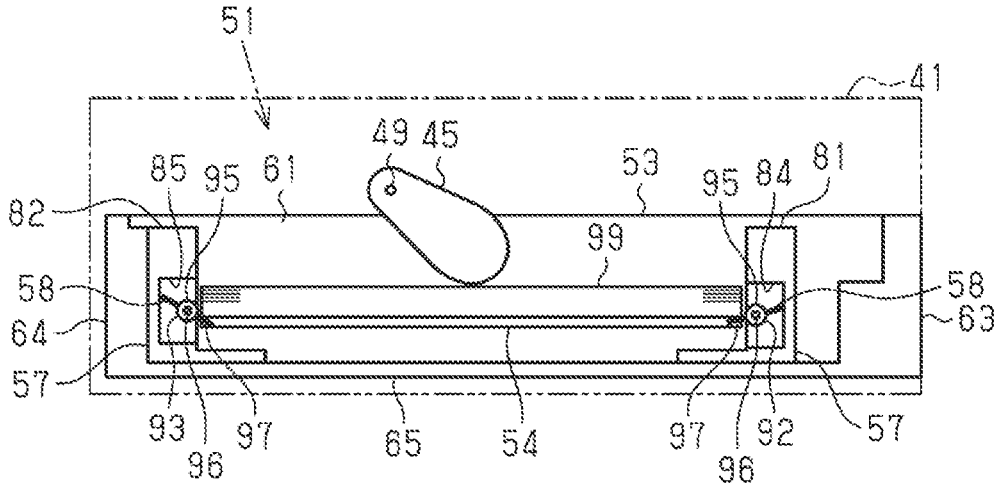
FIG. 12 is a cross-sectional view when a rotating body rotates in the state illustrated in FIG. 3
Figure 13:
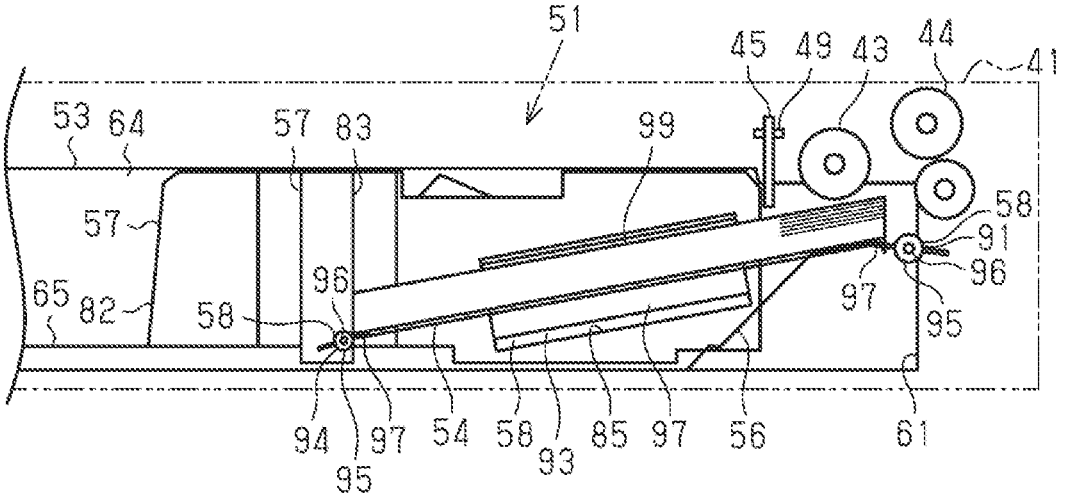
FIG. 13 is a cross-sectional view when the rotating body rotates in the state illustrated in FIG. 4

As illustrated in FIGS. 12 and 13, the rotation of the rotating member 95 about the rotary shaft 96 causes the vane 97 to rotate about the rotary shaft 96. The vane 97 is rotated to spin out of the accommodation port. In this manner, the vane 97 contacts the plurality of media 99 placed at the hopper 54. At this time, the vane 97 contacts the end of the medium 99. In other words, the vane 97 of the first rotating body 91 contacts the tip of the medium 99. The vane 97 of the second rotating body 92 contacts the side end of the medium 99. The vane 97 of the third rotating body 93 contacts the side end of the medium 99. The vane 97 of the fourth rotating body 94 contacts the back end of the medium 99.

The vane 97 is in contact with the end of the medium 99 so as to strike the end of the medium 99. When the vane 97 contacts the end of the medium 99, the end of the medium 99 vibrates. This imparts vibration to the medium 99. In the first embodiment, the vane 97 contacts the end of the medium 99 so as to move in a direction orthogonal to the upper surface 71. Thus, vibration in a direction orthogonal to the upper surface 71 is imparted to the end of the medium 99. More specifically, vibration in a direction orthogonal to the surface of the medium 99 is imparted to the end of the medium 99. Thus, in the first embodiment, the rotating bodies 58 function as vibration imparting units that impart vibration to the medium 99. In the first embodiment, the four rotating bodies 58 impart vibration to the tip, the back end, and the both side ends of the medium 99.

The vane 97 contacts the medium 99 so as to lift up the medium downward to upward. In other words, the rotating member 95 rotates so that the vane 97 comes into contact with the medium 99 from below. In the first embodiment, the first rotating body 91 rotates in a clockwise direction in FIG. 13. The second rotating body 92 rotates in a clockwise direction in FIG. 12. The third rotating body 93 rotates in a counterclockwise direction in FIG. 12. The fourth rotating body 94 rotates in a counterclockwise direction in FIG. 13.

When the vibration is imparted to the medium 99, dust adhering to the medium 99 falls due to the vibration. In particular, when the medium 99 is paper, the end of the medium 99 may be a cut surface that has been cut out. As a result, paper powder is easily produced from the end of the medium 99. Thus, when the vibration is imparted to the medium 99, dust, paper powder, etc. are removed from the medium 99 by the vibration. By removing dust, paper powder, etc. from the medium 99 by the supply device 18, the risk of dust, paper powder, etc. adhering to various configurations within the processing device 11 can be reduced.

Next, a process in which the supply device 18 of the first embodiment imparts vibration to the medium 99 will be described. In the first embodiment, when the sensor 47 detects that the removal cassette 51 is mounted to the housing 41, the supply control unit 48 executes a first process as a process for imparting vibration to the medium 99.

Figure 14:
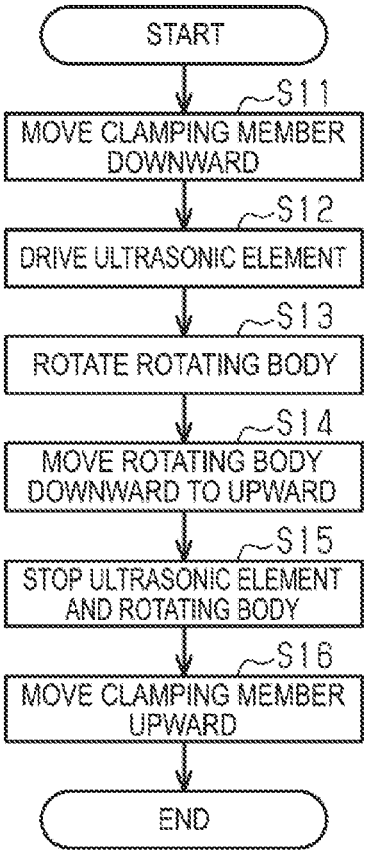
FIG. 14 is a flowchart illustrating an example of a first process.

As illustrated in FIG. 14, the supply control unit 48, which executes the first process, moves the clamping member 45 downward in step S11. As a result, the clamping member 45 clamps the medium 99.

The supply control unit 48 drives the ultrasonic element 55 in step S12. This imparts vibration to the medium 99. In the first embodiment, the ultrasonic element 55 assists in imparting vibration to the medium 99. At this time, the supply control unit 48 may vibrate the lifting member 56.

The supply control unit 48 rotates the rotating bodies 58 in step S13. As a result, the rotating bodies 58 contact the ends of the plurality of media 99. The rotating bodies 58 impart vibration to the pickup roller 43 and the medium 99 clamped by the clamping member 45. At this time, the portion clamped by the pickup roller 43 and the clamping member 45 acts as a fixed end, and the ends of the medium 99 contacted by the rotating bodies 58 act as free ends, so that the medium 99 vibrates.

The supply control unit 48 moves the rotating bodies 58 downward to upward in step S14.

The supply control unit 48 stops the ultrasonic element 55 and the rotating bodies 58 in step S15. The supply control unit 48 executes step S15 after a predetermined amount of time has elapsed since executing step S14. The predetermined time is, for example, a time until the movement of the rotating bodies 58 is completed.

The supply control unit 48 moves the clamping member 45 upward in step S16. This causes the clamping member 45 to move away from the medium 99. When the processing of step S16 is finished, the supply control unit 48 ends the first process.

In this manner, the control method for controlling the supply device 18 includes imparting vibration to the medium 99 by the rotating bodies 58 when the medium 99 is accommodated in the removal cassette 51. The supply control unit 48 causes the rotating bodies 58 to impart vibration to the medium 99 when the medium 99 is accommodated in the removal cassette 51 by executing a program stored in the memory. The program may be readable from a storage medium such as a CD, USB memory, etc.

Next, the functions and effects of the first embodiment will be described.

(1) The rotating bodies 58, which are the vibration imparting units, impart vibration to the medium 99 by contacting the respective ends of the plurality of media 99 accommodated in the removal cassette 51, which is the accommodating unit.

According to the above-described configuration, the rotating bodies 58 contact the ends of the plurality of media 99, thereby imparting vibration to the plurality of media 99. Therefore, dust, paper powder, etc. can be removed from the plurality of media 99.

(2) The rotating bodies 58, which are the vibration imparting unit, impart vibration to the medium 99 in a direction orthogonal to the surface of the medium 99.

Since the medium 99 has a sheet shape, the vibration in a direction orthogonal to the surface is more easily imparted than when the vibration in a direction along the surface thereof is imparted. Thus, according to the above-described configuration, the medium 99 is effectively vibrated.

(3) When the upper surface 71, which is the placement surface, is viewed in plan view, the rotating bodies 58, which are the vibration imparting units, contact a portion of the end of the medium 99 that does not overlap the upper surface 71. The portion of the end of the medium 99 that does not overlap the upper surface 71 is not supported by the upper surface 71, and thus is prone to vibration. Thus, according to the above-described configuration, the medium 99 is effectively vibrated.

(4) When the upper surface 71, which is the placement surface, is viewed in plan view, the pickup roller 43 and the clamping member 45 contact a portion of the medium 99 overlapping the upper surface 71. The rotating bodies 58, which are the vibration imparting unit, impart vibration to the medium 99 by contacting the medium 99 clamped by the pickup roller 43 and the clamping member 45.

According to the above-described configuration, the portion clamped by the pickup roller 43 and the clamping member 45 acts as the fixed end, and the portions where the rotating bodies 58 come into contact act as the free ends, so that the medium 99 placed at the upper surface 71 vibrates. In this case, the vibration of the medium 99 has higher frequency in comparison to a case where the medium 99 is not clamped by the pickup roller 43 and the clamping member 45. In other words, the vibration frequency of the medium 99 is increased. As a result, dust, paper powder, etc. are effectively removed.

(5) The pickup roller 43 functions as the clamping unit for clamping the medium 99.

According to the above-described configuration, the pickup roller 43 that feeds the medium 99 also functions as the clamping unit, so the configuration of the supply device 18 can be simplified.

(6) The rotating member 95 rotates so that the vane 97 comes into contact, from below, with the end of the medium 99 placed at the upper surface 7.

According to the above-described configuration, the vane 97 contacts the end of the medium 99 so as to lift up the end of the medium 99. The end of the medium 99 drops downward by the action of gravity after being lifted up by the vane 97. Conversely, when the rotating member 95 rotates so that the vane 97 comes into contact with the end of the medium 99 from above, the end of the medium 99 is displaced upward by the rigidity of the medium 99 itself after being depressed by the vane 97. Thus, when the rotating member 95 rotates so that the vane 97 comes into contact, from below, with the end of the medium 99, the medium 99 vibrates effectively since the gravity acts more effectively than when the rotating member 95 rotates so that the vane 97 contact the end of the medium 99 from above.

(7) Among the rotating bodies 58 that are the vibration imparting units, the second rotating body 92, the third rotating body 93, and the fourth rotating body 94 move together with the respective edge guides 57.

According to the above-described configuration, the second rotating body 92, the third rotating body 93, and the fourth rotating body 94 move along with the movement of the respective edge guides 57. Thus, regardless of the size of the medium 99 accommodated in the removal cassette 51, the second rotating body 92, the third rotating body 93, and the fourth rotating body 94 can contact the end of the medium 99. That is, the second rotating body 92, the third rotating body 93, and the fourth rotating body 94 can impart vibration to the medium 99 regardless of the size of the medium 99.

(8) Each of the plurality of rotating bodies 58, which is the vibration imparting unit, contacts respective different ends of the medium 99.

According to the above-described configuration, the medium 99 effectively vibrates compared to a case where only one rotating body 58 is provided.

(9) The rotating bodies 58, which are the vibration imparting unit, move upward and downward.

According to the above-described configuration, the rotating bodies 58 can effectively contact the plurality of media 99 to be stacked.

(10) One delivery path 46 corresponding to the removal cassette 51, which is the first accommodating unit, and another delivery path 46 corresponding to the normal cassette 52, which is the second accommodating unit, are coupled to each other.

According to the above-described configuration, the medium 99 from which dust, paper powder, etc. have been removed in the removal cassette 51 can be fed through the delivery path 46 towards the normal cassette 52. Therefore, even when the rotating bodies 58 are not provided to the normal cassette 52, dust, paper powder, etc. can be removed from the medium 99 accommodated in the normal cassette 52.

(11) The removal cassette 51, which is the first accommodating unit, is located below the normal cassette 52, which is the second accommodating unit.

According to the above-described configuration, the risk of dust, paper powder, etc. removed from the medium 99 in the removal cassette 51 reaching the normal cassette 52 is reduced.

(12) The cassette 42, which is the accommodating unit, vertically overlaps the processing unit 13.

According to the above-described configuration, the installation area of the processing device 11 can be reduced compared to a case where the cassette 42 does not overlap the processing unit 13 vertically.

Second Embodiment

Next, a second embodiment of the supply device will be described. In the second embodiment, features different from the first embodiment will be mainly described. In the second embodiment, descriptions of the configurations common to the first embodiment will be omitted. The supply device of the second embodiment may be embedded in the processing device 11 or may be external to the processing device 11.

Figure 15:
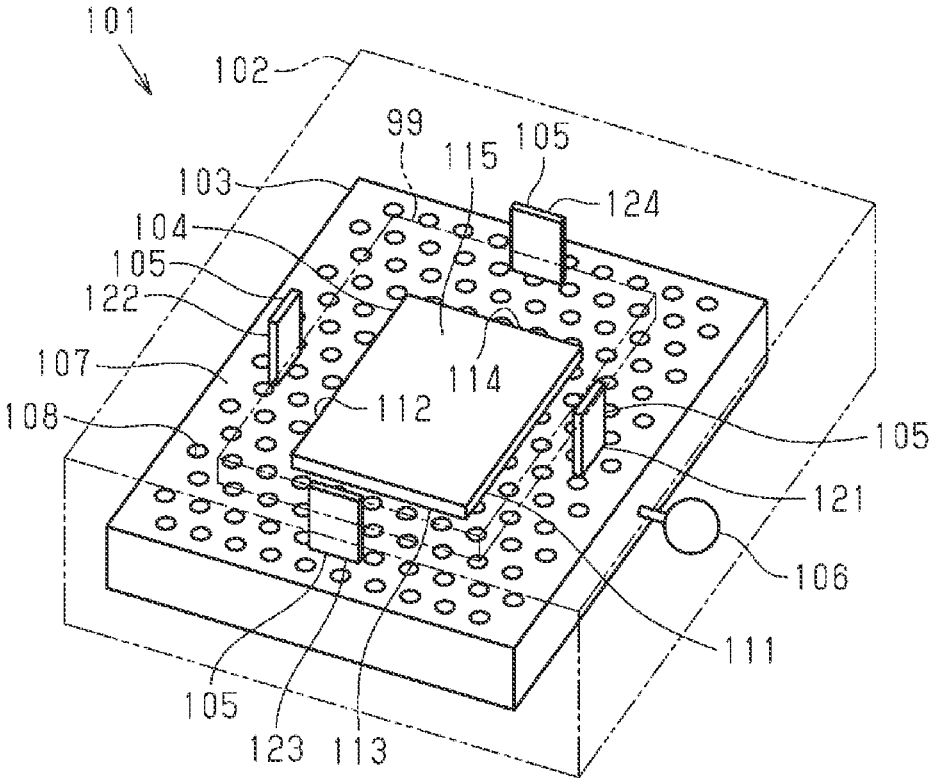
FIG. 15 is a perspective view illustrating an accommodating cassette included in a supply device according to a second embodiment.
Figure 16:
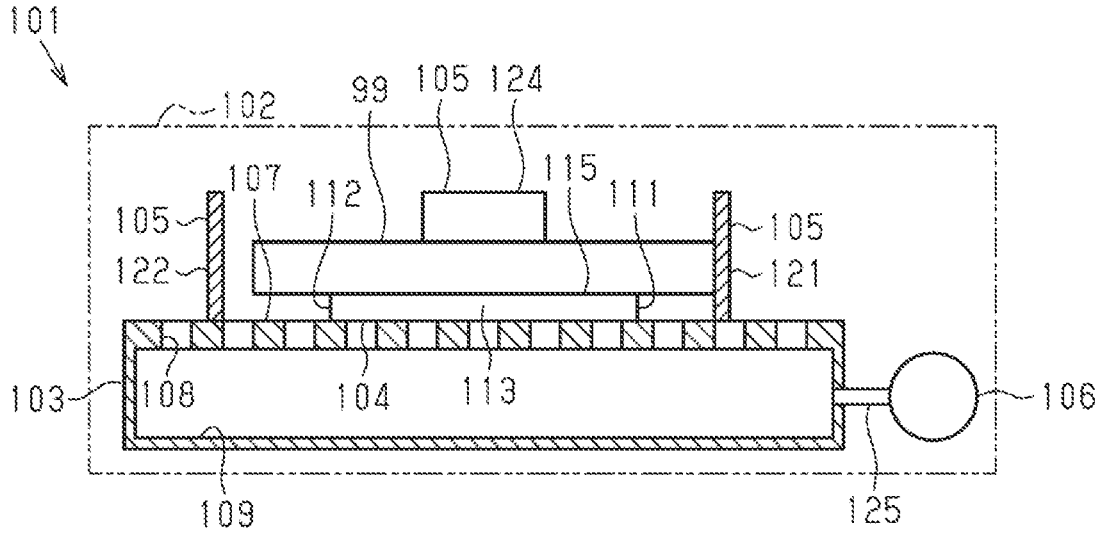
FIG. 16 is a cross-sectional view of the accommodating cassette.

As illustrated in FIGS. 15 and 16, the supply device 101 of the second embodiment includes an accommodating cassette 102 accommodating the medium 99. Although not illustrated, the supply device 101 of the second embodiment includes, similar to the first embodiment, the housing 41 at which the accommodating cassette 102 is mounted, the pickup roller 43 that feeds the medium 99 accommodated in the accommodating cassette 102, the sensor 47 for detecting mounting of the accommodating cassette 102, the supply control unit 48 that controls the supply device 101, etc.

The accommodating cassette 102 is an accommodating unit that accommodates the medium 99. The accommodating cassette 102 accommodates the plurality of media 99 in landscape orientation, similar to the first embodiment. The accommodating cassette 102 has a configuration corresponding to the removal cassette 51 of the first embodiment.

The accommodating cassette 102 has a casing 103, a table 104, a cursor 105, and a suction unit 106.

The casing 103 supports the table 104 and the cursor 105, for example. The casing 103 is provided, for example, in a cuboid shape. The casing 103 is coupled to the suction unit 106. The casing 103 has a support surface 107, an opening 108, and an accommodating chamber 109.

The support surface 107 is a surface that supports the table 104 and the cursor 105. In the second embodiment, the support surface 107 faces upward.

The opening 108 is provided to the support surface 107. As such, the opening 108 opens upward. The opening 108 is passed through the inside of the casing 103 and the outside of the casing 103. One or more openings 108 are provided.

In the second embodiment, a plurality of the openings 108 is provided. The openings 108 may be regularly aligned or unordered.

The accommodating chamber 109 is a space being provided inside the casing 103. The accommodating chamber 109 communicates with the outside of the casing 103 by the openings 108. The accommodating chamber 109 is coupled to the suction unit 106.

The table 104 is, for example, a plate-like member. The table 104 is provided to the support surface 107 of the casing 103. The table 104 is provided in a cuboid shape, for example. The table 104 is smaller than the casing 103. Specifically, when the table 104 is viewed in plan view, the area of the table 104 is smaller than the area of the casing 103.

The table 104 supports, from below, the medium 99 accommodated by the accommodating cassette 102. In other words, the medium 99 is placed at the table 104. The table 104 includes a first surface 111, a second surface 112, a third surface 113, a fourth surface 114, and an upper surface 115.

The first surface 111, the second surface 112, the third surface 113, and the fourth surface 114 are surfaces that interface with the upper surface 115. The first surface 111 and the second surface 112 are surfaces facing opposite to each other. The first surface 111 and the second surface 112 interface with the third surface 113 and the fourth surface 114, respectively. The third surface 113 and the fourth surface 114 are surfaces facing opposite to each other. The third surface 113 and the fourth surface 114 interface with the first surface 111 and the second surface 112, respectively.

The upper surface 115 is a surface at which the medium 99 is placed. In this regard, the upper surface 115 is a placement surface at which the medium 99 is placed. The upper surface 115 is located above the casing 103. The area of the upper surface 115 is smaller than the area of the support surface 107.

The table 104 is configured to be movable over the casing 103. Specifically, the table 104 is movable in four directions from a normal position. The table 104 is movable in a direction along the upper surface 115. The normal position is, for example, a position that is the center of the support surface 107 when the casing 103 is viewed in plan view. The table 104 is typically located at the normal position. The table 104 illustrated in FIGS. 15 and 16 is located at the normal position.

The table 104 is movable in two directions orthogonal to the first surface 111 and the second surface 112 when the table 104 is viewed in plan view. In other words, the table 104 is movable in two directions along the third surface 113 and the fourth surface 114 when the table 104 is viewed in plan view. Furthermore, the table 104 is movable in two directions orthogonal to the third surface 113 and the fourth surface 114 when the table 104 is viewed in plan view. In other words, the table 104 is movable in two directions along the first surface 111 and the second surface 112 when the table 104 is viewed in plan view.

When the table 104 is viewed in plan view, the medium 99 placed at the table 104 is placed so that the end thereof protrudes from the table 104. In other words, the area of the table 104 is typically smaller than the area of the medium 99 to be placed.

The cursor 105 is a plate-like member. The cursor 105 is a member that aligns the position of the plurality of media 99 by contacting the plurality of media 99. The cursor 105 aligns the position of the end of the medium 99 placed at the table 104 by contacting the end of the medium 99 placed at the table 104. In this regard, the cursor 105 is an alignment unit that aligns the medium 99.

One or more cursors 105 are provided. In the first embodiment, three cursors 105 are provided. Thus, in the first embodiment, the cursors 105 includes a first cursor 121, a second cursor 122, a third cursor 123, and a fourth cursor 124. The first cursor 121, the second cursor 122, the third cursor 123, and the fourth cursor 124 are located to surround the four sides of the table 104.

The first cursor 121 is provided over the casing 103. The first cursor 121 is configured to be movable over the casing 103. The first cursor 121 faces the first surface 111 with respect to the table 104. The first cursor 121 is parallel to the first surface 111. The first cursor 121 is movable in two directions orthogonal to the first surface 111 in a state parallel with the first surface 111. The first cursor 121 is movable in a direction away from the first surface 111 and in a direction approaching the first surface 111. The first cursor 121 contacts an end of the medium 99 placed at the table 104 by moving in a direction approaching the first surface 111. For example, the first cursor 121 contacts a side end of the medium 99.

The second cursor 122 is provided over the casing 103. The second cursor 122 is configured to be movable over the casing 103. The second cursor 122 faces the second surface 112 with respect to the table 104. The second cursor 122 is parallel to the second surface 112. The second cursor 122 is movable in two directions orthogonal to the second surface 112 in a state parallel with the second surface 112. The second cursor 122 is movable in a direction away from the second surface 112 and in a direction approaching the second surface 112. The second cursor 122 contacts an end that is opposite to the end of the medium 99 contacted by the first cursor 121, by moving in a direction approaching the second surface 112. For example, the second cursor 122 contacts a side end that is opposite to the side end of the medium 99 with which the first cursor 121 comes int contact.

The third cursor 123 is provided over the casing 103. The third cursor 123 is configured to be movable over the casing 103. The third cursor 123 faces the third surface 113 with respect to the table 104. Third cursor 123 is parallel to the third surface 113. The third cursor 123 is movable in two directions orthogonal to the third surface 113 in a state parallel with the third surface 113. The third cursor 123 is movable in a direction away from the third surface 113 and in a direction approaching the third surface 113. The third cursor 123 contacts an end different from the respective ends of the medium 99 with which the first cursor 121 and the second cursor 122 each come into contact, by moving in a direction approaching the third surface 113. For example, the third cursor 123 contacts the back end of the medium 99.

The fourth cursor 124 is provided over the casing 103. The fourth cursor 124 is configured to be movable over the casing 103. The fourth cursor 124 faces the fourth surface 114 with respect to the table 104. The fourth cursor 124 is parallel to the fourth surface 114. The fourth cursor 124 is movable in two directions orthogonal to the fourth surface 114 in a state parallel with the fourth face 114. The fourth cursor 124 is movable in a direction away from the fourth surface 114 and a direction approaching the fourth surface 114. The fourth cursor 124 contacts an end that is opposite to the end of the medium 99 contacted by the third cursor 123, by moving in a direction approaching the fourth surface 114. For example, the fourth cursor 124 contacts the tip of the medium 99.

The first cursor 121 and the second cursor 122 contact the medium 99 so as to sandwich the medium 99, thereby aligning the positions of the both side ends of the medium 99. The third cursor 123 and the fourth cursor 124 contact the medium 99 so as to sandwich the medium 99, thereby aligning the position of the tip of the medium 99 and aligning the position of the back end of the medium 99.

Movements of the first cursor 121, the second cursor 122, the third cursor 123, and the fourth cursor 124 will be described collectively as a movement of the cursors 105. The cursors 105 move between a position closest to the table 104 located at the normal position and a position furthest away from the table 104 located at the normal position. Even when located at any position, by the movement of the table 104 from the normal position, the cursors 105 contact the medium 99 placed at the table 104.

Figure 17:
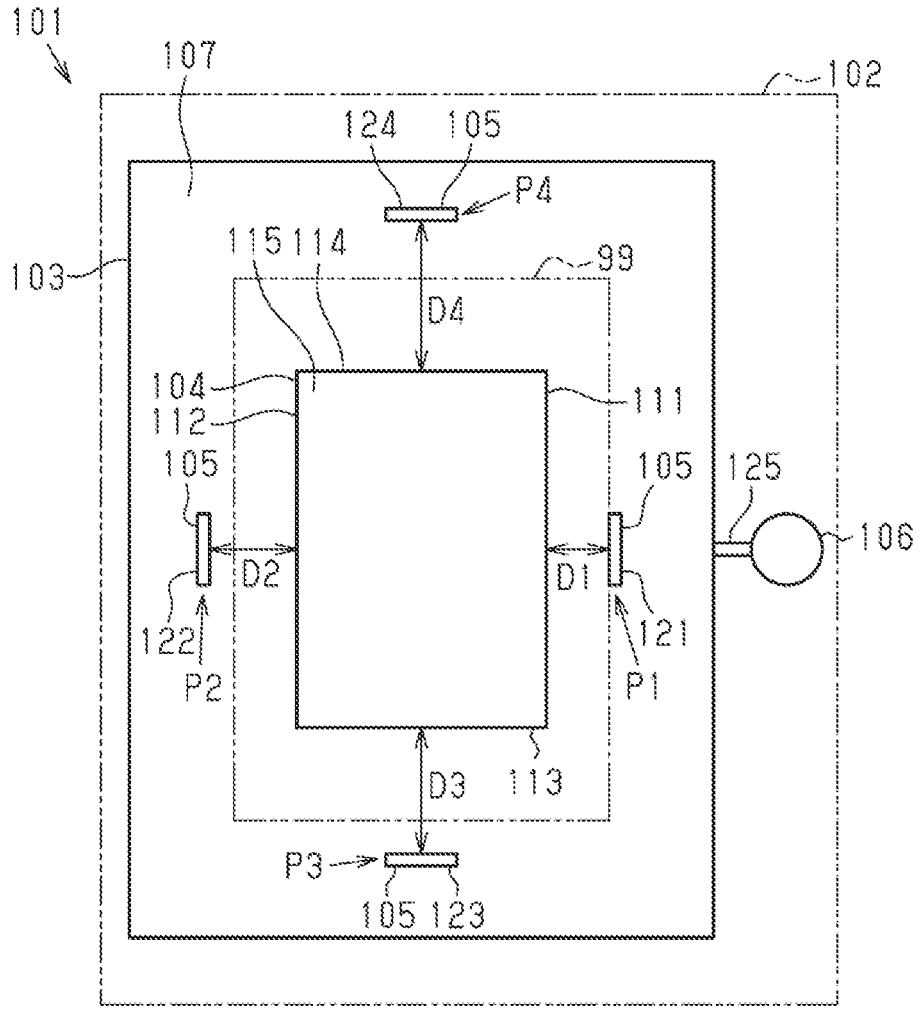
FIG. 17 is a plan view of the accommodating cassette.

As illustrated in FIG. 17, the cursors 105 are displaced over the casing 103 to, for example, a first position P1, a second position P2, a third position P3, and a fourth position P4. The first position P1, the second position P2, the third position P3, and the fourth position P4 are positions where each cursors 105 is separated by a predetermined distance from the table 104 located at the normal position.

In the first cursor 121, the first position P1, the second position P2, the third position P3, and the fourth position P4 are defined by a distance between the first cursor 121 and the first surface 111. In the second cursor 122, the first position P1, the second position P2, the third position P3, and the fourth position P4 are defined by a distance between the second cursor 122 and the second surface 112. In the third cursor 123, the first position P1, the second position P2, the third position P3, and the fourth position P4 are defined by a distance between the third cursor 123 and the third surface 113. In the fourth cursor 124, the first position P1, the second position P2, the third position P3, and the fourth position P4 are defined by a distance between the fourth cursor 124 and the fourth surface 114.

In an example illustrated in FIG. 17, the first cursor 121 is at the first position P1, the second cursor 122 is at the second position P2, the third cursor 123 is at the third position P3, and the fourth cursor 124 is at the fourth position P4.

The first position P1 is a position at which the cursor 105 contacts the end of the medium 99 placed at the table 104 located at the normal position. For example, the first position P1 is a position where a distance from the table 104 located at the normal position to the cursor 105 is a first distance D1. On the other hand, the second position P2, the third position P3, and the fourth position P4 are positions where the cursor 105 do not come into contact with the ends of the medium 99 placed at the table 104 located at the normal position.

The second position P2 is a position further away from the table 104 located at the normal position than the first position P1. Thus, a distance between the cursor 105 located at the second position P2 and the table 104 located at the normal position is greater than the distance between cursor 105 located at first position P1 and table 104 located at the normal position. For example, the second position P2 is a position where a distance from the table 104 located at the normal position to the cursor 105 is a second distance D2. The second distance D2 is greater than the first distance D1.

The third position P3 is a position further away from the table 104 located at the normal position than the second position P2. Thus, a distance between the cursor 105 located at the third position P3 and the table 104 located at the normal position is greater than the distance between cursor 105 located at second position P2 and table 104 located at the normal position. For example, the third position P3 is a position where a distance from the table 104 located at the normal position to the cursor 105 is a third distance D3. The third distance D3 is greater than the second distance D2.

The fourth position P4 is a position further away from the table 104 located at the normal position than the third position P3. Thus, a distance between the cursor 105 located at the fourth position P4 and the table 104 located at the normal position is greater than the distance between cursor 105 located at third position P3 and table 104 located at the normal position. For example, the fourth position P4 is a position where the distance from the table 104 located at the normal position to the cursor 105 is a fourth distance D4. The fourth distance D4 is greater than the third distance D3.

The cursor 105 contact the medium 99 placed at the table 104 as the table 104 approaches that cursors 105 away from the table 104. Specifically, the table 104 approaches the cursor 105 at a predetermined distance from the table 104, so that ends of the plurality of media 99 collides with that cursor 105. At this time, vibration is imparted to the end of the plurality of media 99. In this regard, the cursor 105 is a vibration imparting unit. Accordingly, in the second embodiment, the vibration imparting unit is the alignment unit. Therefore, the vibration imparting unit can move with the alignment unit.

The cursor 105 is operated by being controlled by the supply control unit 48. The cursor 105 imparts vibration in a direction along the surface of the medium 99 to the medium 99 due to the collision of the medium 99.

Hereinafter, a case is considered where the table 104 moves toward the cursor 105 located at the third position P3. In this case, an acceleration distance of the table 104 is longer than that of the case where the table 104 moves toward the cursor 105 located at the second position P2. When the acceleration distance of the table 104 increases, the speed of the table 104 when the medium 99 collides with the cursor 105 increases. As a result, the impact applied to the medium 99 increases. That is, the impact on the medium 99 when the medium 99 collides with the cursor 105 in the case where the cursor 105 is located at the third position P3 is larger than that of the case where the cursor 105 is located at the second position P2. Similarly, the impact on the medium 99 when the medium 99 collides with the cursor 105 in the case where the cursor 105 is located at the fourth position P4 is larger than those of the case where the cursor 105 is located at the second position P2 and the case where the cursor 105 is located at the third position P3. The greater the impact on the medium 99, the greater the vibration imparted to the medium 99. As a result, the end of the medium 99 greatly vibrates.

For the medium 99 placed at the table 104, vibration is imparted to each of the ends of the medium 99 by sequentially colliding with the first cursor 121, the second cursor 122, the third cursor 123, and the fourth cursor 124. Finally, all the cursors 105, i.e., the first cursor 121, the second cursor 122, the third cursor 123, and the fourth cursor 124 are displaced to the first position P1. At this time, the table 104 is located at the normal position. Thus, finally, the medium 99 placed at the table 104 contacts all of the first cursor 121, the second cursor 122, the third cursor 123, and the fourth cursor 124. As a result, the medium 99 is aligned.

In the second embodiment, the supply control unit 48 controls the table 104 and the cursor 105 to remove dust, paper powder, etc. and to align the medium 99. The supply control unit 48 executes a second process when the sensor 47 detects that the accommodating cassette 102 is mounted to the housing 41. In the second process, by imparting vibration to the medium 99, dust, paper powder, etc. are removed from the medium 99 as well as the medium 99 is aligned. In other words, in the second embodiment, the supply control unit 48 executes the second process to align the medium 99 while the alignment unit imparts vibration to the medium 99.

Figure 18:
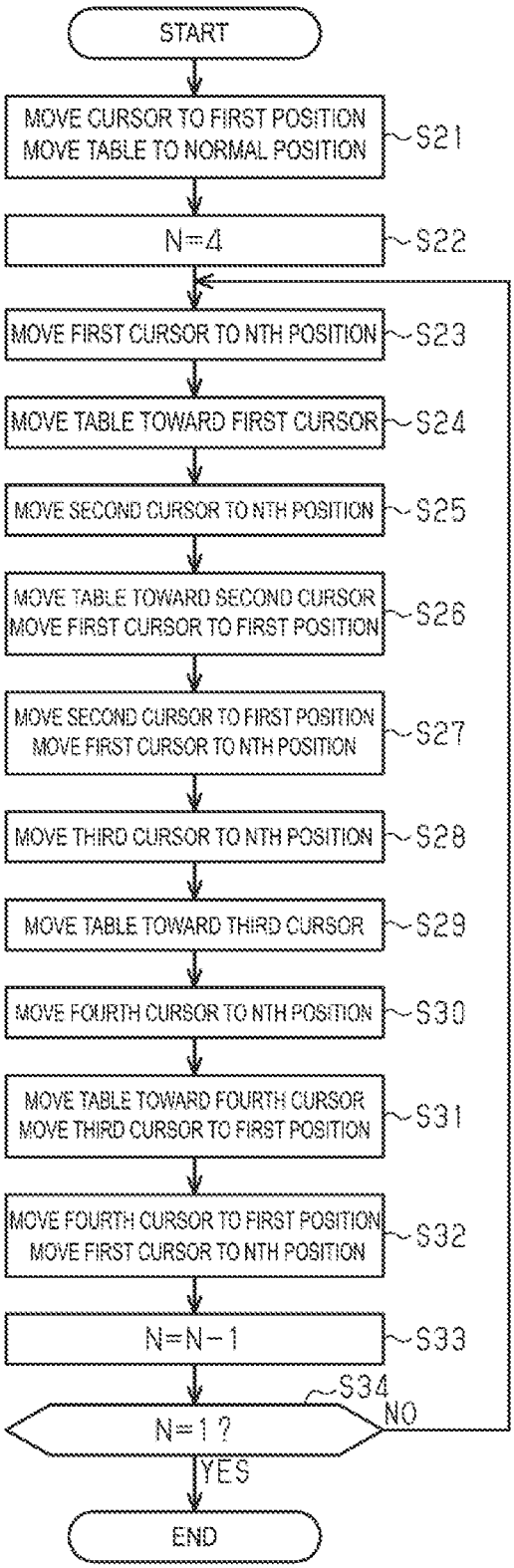
FIG. 18 is a flowchart illustrating an example of a second process.

As illustrated in FIG. 18, the supply control unit 48, which executes the second process, moves the cursors 105 to the first position P1 in step S21. At this time, the supply control unit 48 moves all of the cursors 105 to the first position P1. Furthermore, in step S21, the supply control unit 48 moves the table 104 to the normal position. As such, the cursors 105 contact the ends of the medium 99 placed at the table 104. At this time, the medium 99 is aligned.

The supply control unit 48 sets a variable N to 4 in step S22. The variable N is a parameter stored by the supply control unit 48.

The supply control unit 48 moves the first cursor 121 to an Nth position in step S23. When the supply control unit 48 executes step S23 immediately after executing step S22, the first cursor 121 is moved to the fourth position P4 since the variable N is 4. At this time, the first cursor 121 is separated from the side end of the medium 99 placed at the table 104.

The supply control unit 48 moves the table 104 toward the first cursor 121 in step S24. Specifically, the supply control unit 48 moves the table 104 toward first cursor 121 until the medium 99 collides with the first cursor 121 in step S24. When the medium 99 collides with the first cursor 121, vibration is imparted to the side end of the medium 99 that collides with the first cursor 121.

The supply control unit 48 moves the second cursor 122 to the Nth position in step S25. For example, the supply control unit 48 moves the second cursor 122 to the fourth position P4 in step S25.

The supply control unit 48 moves the table 104 toward the second cursor 122 in step S26. In particular, the supply control unit 48 moves the table 104 toward the second cursor 122 until the medium 99 collides with the second cursor 122 in step S26. When the medium 99 collide with the second cursor 122, vibration is imparted to the side end of the medium 99 that collides with the second cursor 122. In addition, the supply control unit 48 moves the first cursor 121 to the first position P1 in step S26.

The supply control unit 48 moves the second cursor 122 to the first position P1 in step S27. Furthermore, in step S27, the supply control unit 48 moves the table 104 to the normal position. At this time, the medium 99 is aligned.

The supply control unit 48 moves the third cursor 123 to the Nth position in step S28. For example, the supply control unit 48 moves the third cursor 123 to the fourth position P4 in step S28.

The supply control unit 48 moves the table 104 toward the third cursor 123 in step S29. Specifically, the supply control unit 48 moves the table 104 toward the third cursor 123 until the medium 99 collides with the third cursor 123 in step S29. When the medium 99 collide with the third cursor 123, vibration is imparted to the back end of the medium 99 that collides with the third cursor 123.

The supply control unit 48 moves the fourth cursor 124 to the Nth position in step S30. For example, the supply control unit 48 moves the fourth cursor 124 to the fourth position P4 in step S30.

The supply control unit 48 moves the table 104 toward the fourth cursor 124 in step S31. Specifically, the supply control unit 48 moves the table 104 toward the fourth cursor 124 until the medium 99 collides with the fourth cursor 124 in step S31. When the medium 99 collide with the fourth cursor 124, vibration is imparted to the tip of the medium 99 that collides with the fourth cursor 124. In addition, the supply control unit 48 moves the third cursor 123 to the first position P1 in step S31.

The supply control unit 48 moves the fourth cursor 124 to the first position P1 in step S32. Furthermore, in step S32, the supply control unit 48 moves the table 104 to the normal position. At this time, the medium 99 is aligned.

The supply control unit 48 subtracts the variable N by one in step S33. In other words, the supply control unit 48 decrements the variable N in step S33.

The supply control unit 48 determines whether or not the variable N is 1 in step S34. When the variable N is 1, the supply control unit 48 ends the second process. When the variable N is not 1, the supply control unit 48 returns processing back to step S23.

When the process returns to step S23, the supply control unit 48 repeatedly executes processing from step S23 to step S34 again. In other words, in this case, for processing from step S23 to step S34, the supply control unit 48 transitions to the second loop of processing after ending the first loop of processing.

In the second loop of processing, the variable N is 3. Thus, in step S23, step S25, step S28 and step S30 of the second loop, unlike the first loop, the first cursor 121, the second cursor 122, the third cursor 123 and the fourth cursor 124 move to the third position P3. That is, the acceleration distance of the table 104 at the second loop is shorter than the acceleration distance of the table 104 in the first loop. Therefore, the impact applied to the medium 99 at the second loop becomes smaller than the impact applied to the medium 99 in the first loop.

When processing from step S23 to step S34 of the second loop of processing is completed, the supply control unit 48 transitions to the third loop of processing. In the third loop of processing, the variable N is 2. Thus, in steps S23, S25, S28 and S30, the first cursor 121, the second cursor 122, the third cursor 123 and the fourth cursor 124 move to the second position P2. That is, the acceleration distance of the table 104 at the third loop is shorter than the acceleration distance of the table 104 at the second loop. Thus, the impact on the medium 99 at the third loop becomes smaller than the impact on the medium 99 in the second loop. In step S34 of the third loop, N is 1. Thus, when processing from step S23 to step S34 of the third loop of processing is completed, the supply control unit 48 ends the second process.

In the second embodiment, the distance between the cursors 105 and the table 104 at which the medium 99 collides is controlled to be gradually reduced as the processing from step S23 to step S34 proceeds with the first, second, and third loops. In this manner, the cursors 105 imparts vibration to the medium 99 by moving the table 104 toward the cursors 105 from a state in which the medium 99 placed at the table 104 is not in contact with the cursor 105 to cause the medium 99 to contact the cursors 105 a plurality of times. Dust, paper powder, etc. are effectively removed by imparting vibration to the medium 99 a plurality of times.

A process of repeating the processing from step S23 to step S34 is a process in which vibration is imparted to the medium 99 a plurality of times by moving the table 104 to cause the medium 99 to contact the cursors 105 a plurality of times. In the second embodiment, during this process, a distance between the table 104 and the cursors 105 in a state with the medium 99 placed at the table 104 being not in contact with the cursors 105 when the table 104 moves toward the cursors 105, is larger than a distance between the table 104 and the cursors 105 in a state with the medium 99 placed at the table 104 being not in contact with the cursors 105 when the table 104 subsequently moves toward the cursors 105.

As illustrated in FIG. 16, the suction unit 106 includes a pump, for example. The suction unit 106 has a connecting tube 125 coupled to the casing 103. When being driven, the suction unit 106 sucks the accommodating chamber 109. The accommodating chamber 109 is brought to negative pressure by being suctioned into the suction unit 106. As a result, dust, paper powder, etc. removed from the medium 99 accommodated in the accommodating cassette 102 is suctioned into the openings 108. As a result, dust, paper powder, etc. removed from the medium 99 is sucked into the suction unit 106. Thus, the risk of dust, paper powder, etc. removed from the medium 99 floating within the accommodating cassette 102 is reduced.

According to the second embodiment, the following effects can be obtained in addition to the effects of the first embodiment. (13) The cursors 105 align the medium 99 while imparting vibration to the medium 99. In other words, the cursors 105 are the vibration imparting units, and are also the alignment units.

According to the above-described configuration, the cursors 105 can efficiently impart vibration to the medium 99 and align the medium 99.

(14) The medium 99 placed at the upper surface 115, which is the placement surface, is brought into contact with the cursors 105 a plurality of times, thereby imparting vibration to the medium 99 a plurality of times. By imparting vibration a plurality of times, dust, paper powder, etc. are effectively removed from the medium 99.

(15) In the process in which vibration is imparted to the medium 99 a plurality of times by moving the upper surface 115, which is the placement surface, to cause the medium 99 to contact the cursors 105, which are the alignment units, a plurality of times, a distance between the upper surface 115 and the cursors 105 in a state with the medium 99 placed at the upper surface 115 being not in contact with the cursors 105 when the upper surface 115 moves toward the cursors 105, is larger than a distance between the upper surface 115 and the cursors 105 in a state with the medium 99 placed at the upper surface 115 being not in contact with the cursors 105 when the upper surface 115 subsequently moves toward the cursors 105.

According to the above-described configuration, in the process in which vibration is imparted to the medium 99 a plurality of times, the distance between the upper surface 115 and the cursors 105 gradually decreases. Compared to a case where the distance between the upper surface 115 and the cursors 105 is constant, the time required to remove dust, paper powder, etc. can be reduced. In addition, the distance between the upper surface 115 and the cursors 105 is gradually reduced, thereby reducing the magnitude of vibration imparted to the medium 99. This imparts vibration of different magnitudes to the medium 99. By imparting different magnitudes of vibration to the medium 99, dust, paper powder, etc. are effectively removed from the medium 99.

(16) The casing 103 has the openings 108 and the accommodating chamber 109 leading to the openings 108. The suction unit 106 sucks the accommodating chamber 109. According to the above-described configuration, the dust falling from the medium 99 is collected in the accommodating chamber 109 through the openings 108. As a result, the risk of dust, paper powder, etc. removed from the medium 99 flying up can be reduced.

Third Embodiment

Next, a third embodiment will be described. In the third embodiment, features different from the first embodiment will be mainly described. In the third embodiment, descriptions of the configurations common to the first embodiment will be omitted. The supply device of the third embodiment may be embedded in the processing device 11 or may be external to the processing device 11.

Figure 19:
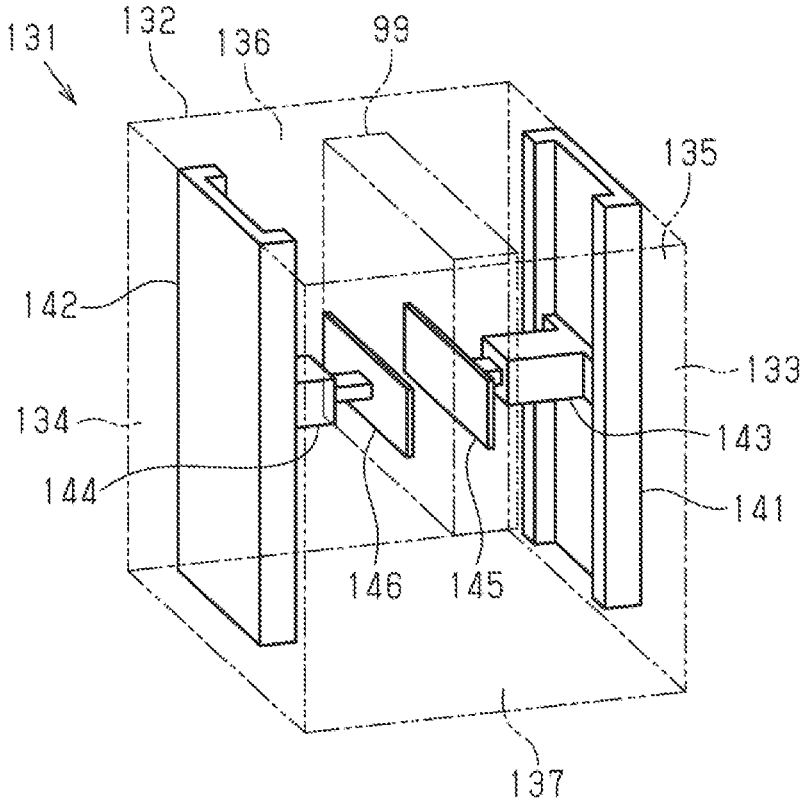
FIG. 19 is a perspective view illustrating a holding cassette included in a supply device according to a third embodiment.
Figure 20:
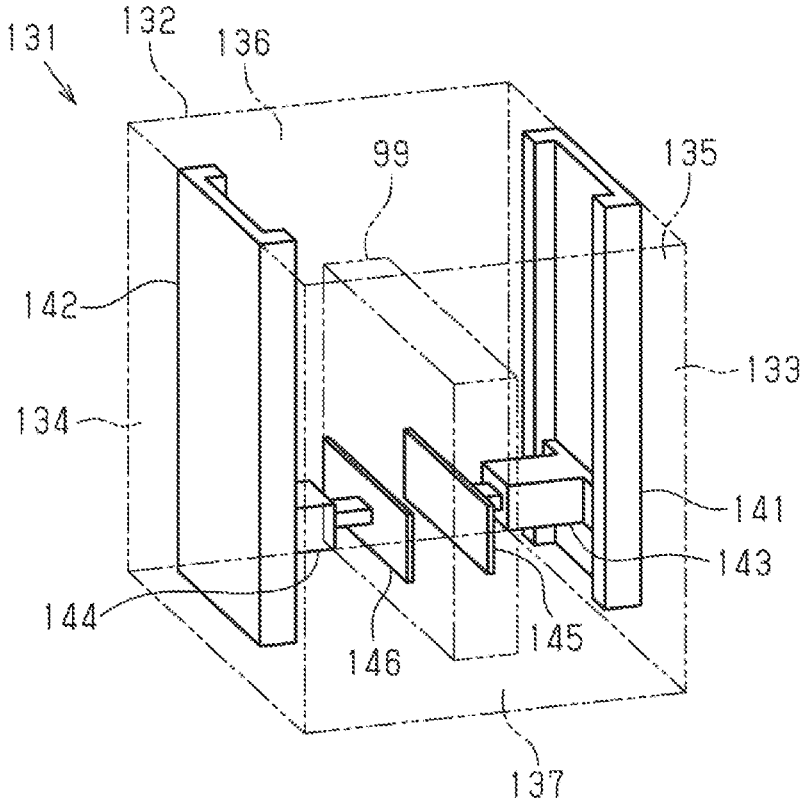
FIG. 20 is a perspective view of the state illustrated in FIG. 19 with a first arm and a second arm being displaced downward.

As illustrated in FIGS. 19 and 20, the supply device 131 of the third embodiment includes a holding cassette 132 accommodating the medium 99. Although not illustrated, the supply device 131 of the third embodiment includes, similar to the first embodiment, the housing 41 at which the holding cassette 132 is mounted, the pickup roller 43 that feeds the medium 99 accommodated in the holding cassette 132, the sensor 47 for detecting mounting of the holding cassette 132, the supply control unit 48 that controls the supply device 131, etc.

The holding cassette 132 is an accommodating unit that accommodates the medium 99. The holding cassette 132 holds the medium 99 in portrait orientation rather than landscape orientation, unlike the cassette 42 of the first embodiment and the accommodating cassette 102 of the second embodiment.

The holding cassette 132 has a first side surface 133, a second side surface 134, a third side surface 135, a fourth side surface 136, and a bottom surface 137. The holding cassette 132 has a first rail 141, a second rail 142, a first arm 143, and a second arm 144.

The first side surface 133, the second side surface 134, the third side surface 135, and the fourth side surface 136 are surfaces that interface with the bottom surface 137. The first side surface 133, the second side surface 134, the third side surface 135, and the fourth side surface 136 extend upward from the bottom surface 137. The first side surface 133 and the second side surface 134 face each other. The first side surface 133 and the second side surface 134 interface with the third side surface 135 and the fourth side surface 136, respectively. The third side surface 135 and the fourth side surface 136 face each other. The third side surface 135 and the fourth side surface 136 interface with the first side surface 133 and the second side surface 134, respectively.

The bottom surface 137 is a bottom surface of the holding cassette 132. The bottom surface 137 contacts the plurality of media 99 accommodated in portrait orientation. That is, the bottom surface 137 contacts ends of the plurality of media 99 to be stacked. The bottom surface 137 is a placement surface at which the medium 99 is placed.

The first rail 141 and the second rail 142 are provided to the first side surface 133 and the second side surface 134, respectively. The first rail 141 and the second rail 142 face each other. The first rail 141 and the second rail 142 extend vertically.

The first arm 143 and the second arm 144 are attached to the first rail 141 and the second rail 142, respectively. The first arm 143 and the second arm 144 move along the first rail 141 and the second rail 142. In other words, the first arm 143 and the second arm 144 are vertically displaced. The first arm 143 extends from the first rail 141 toward the second rail 142. That is, the first arm 143 extends toward the first side surface 133. The second arm 144 extends from the second rail 142 toward the first rail 141. That is, the second arm 144 extends toward the second side surface 134.

The first arm 143 and the second arm 144 include a first pressing member 145 and a second pressing member 146 at the tips thereof, respectively.

The first pressing member 145 and the second pressing member 146 are, for example, plate-like members. The first pressing member 145 and the second pressing member 146 face each other. The first pressing member 145 and the second pressing member 146 mutually press the medium 99 accommodated in the holding cassette 132.

The first pressing member 145 and the second pressing member 146 contact the front surface and the back surface of the plurality of media 99 to be stacked. The first pressing member 145 and the second pressing member 146 sandwich the plurality of media 99 by pressing the front surface and the back surface of the plurality of media 99 to be stacked against each other. Thus, the first arm 143 and the second arm 144 hold the plurality of media 99 therebetween.

The first arm 143 and the second arm 144 move vertically while holding the plurality of media 99 therebetween. Specifically, the first arm 143 and the second arm 144 move upward to downward with the plurality of the mediums 99 being held therebetween. As the first arm 143 and the second arm 144 move downwardly, the lower end of the medium 99 collides with the bottom surface 137. This imparts vibration to the lower end of the medium 99. In this regard, the bottom surface 137 is a vibration imparting unit. In the third embodiment, the supply control unit 48 imparts vibration to the medium 99 by operating the first arm 143 and the second arm 144 when the sensor 47 detects that the holding cassette 132 is mounted to the housing 41. Dust, paper powder, etc. are removed from the medium 99 by causing the lower end of the medium 99 to collide with the bottom surface 137 once or a plurality of times.

When the lower end of the medium 99 contacts the bottom surface 137, the position of the lower end of the medium 99 is aligned. When the position of the lower end of the medium 99 is aligned, the position of the upper end of the medium 99 is also aligned. In this regard, the bottom surface 137 is an alignment unit that aligns the medium 99.

According to the third embodiment, the following effects are obtained in addition to the effects of the first embodiment and the second embodiment.

(17) The bottom surface 137, which is the placement surface, contacts the end of the plurality of media 99 to be stacked.

According to the above-described configuration, the supply device 131 can be miniaturized in a direction along the bottom surface 137.

Fourth Embodiment

Next, a fourth embodiment will be described. In the fourth embodiment, features different from the third embodiment will be mainly described. In the fourth embodiment, the same reference numerals are given to the configurations common to those in the third embodiment, and the description thereof will be omitted. The supply device of the fourth embodiment may be embedded in the processing device 11 or may be external to the processing device 11.

Figure 21:
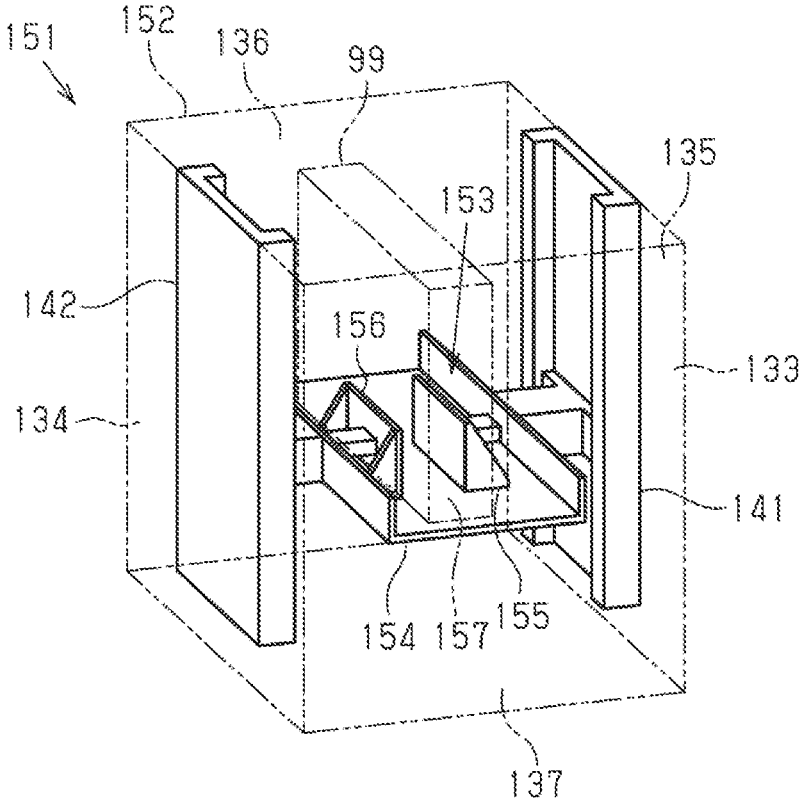
FIG. 21 is a perspective view illustrating a holding cassette included in a supply device according to a fourth embodiment.
Figure 22:
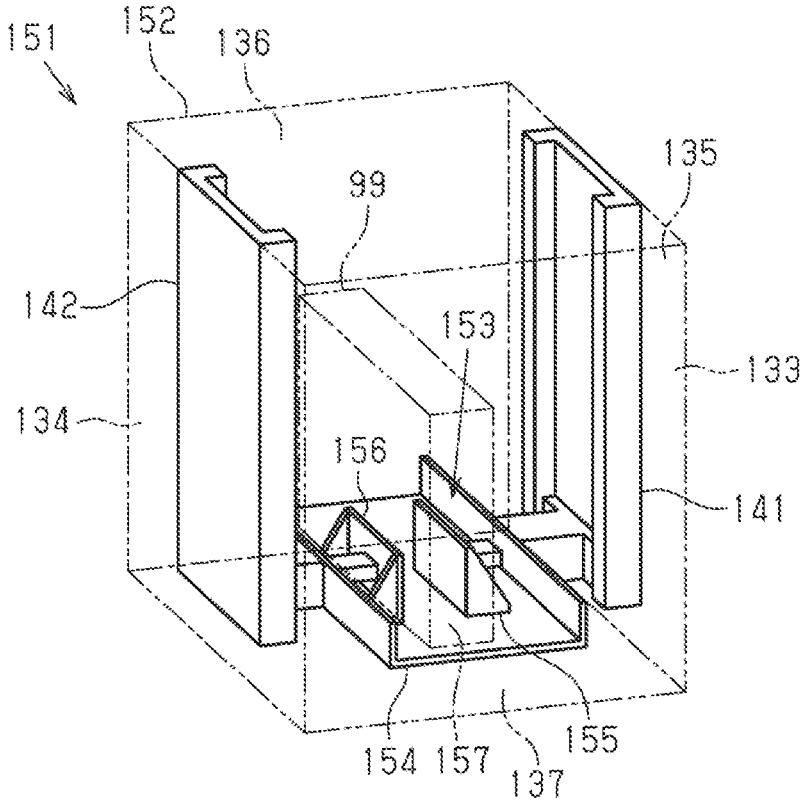
FIG. 22 is a perspective view of the state illustrated in FIG. 21 with a holding unit being displaced downward.

As illustrated in FIGS. 21 and 22, the supply device 151 of the fourth embodiment includes a holding cassette 152 accommodating the medium 99. Although not illustrated, the supply device 151 of the fourth embodiment includes, similar to the first embodiment, the housing 41 at which the holding cassette 152 is mounted, the pickup roller 43 that feeds the medium 99 accommodated in the holding cassette 152, the sensor 47 for detecting mounting of the holding cassette 152, the supply control unit 48 that controls the supply device 151, etc.

The holding cassette 152 is an accommodating unit that accommodates the medium 99. The holding cassette 152 of the fourth embodiment holds the medium 99 in portrait orientation, similar to the holding cassette 132 of the third embodiment. The holding cassette 152, similar to the third embodiment, includes the first side surface 133, the second side surface 134, the third side surface 135, the fourth side surface 136, and the bottom surface 137. The holding cassette 152 has the first rail 141 and the second rail 142, similar to the third embodiment. The holding cassette 152, unlike the third embodiment, has a holding unit 153.

The holding unit 153 is attached to the first rail 141 and the second rail 142. The holding unit 153 moves along the first rail 141 and the second rail 142. In other words, the holding unit 153 is vertically displaced.

The holding unit 153 includes a holding member 154, a first gripping member 155, and a second gripping member 156. The holding member 154 is, for example, a plate-like member. The holding member 154 has a holding surface 157. The holding surface 157 is in contact with the plurality of media 99 accommodated in portrait orientation. In other words, the holding surface 157 contacts ends of the plurality of media 99 to be stacked. As described above, the holding surface 157 is a placement surface at which the medium 99 is placed.

The first gripping member 155 and the second gripping member 156 are, for example, plate-like members. The first gripping member 155 and the second gripping member 156 are provided to the holding surface 157. The first gripping member 155 and the second gripping member 156 face each other. The first gripping member 155 and the second gripping member 156 mutually press the medium 99 accommodated in the holding cassette 152.

The first gripping member 155 and the second gripping member 156 contact the front surface and the back surface of the plurality of media 99 to be stacked. The first gripping member 155 and the second gripping member 156 sandwich the plurality of media 99 by pressing the front surface and the back surface of the plurality of media 99 to be stacked against each other. In this manner, the first gripping member 155 and the second gripping member 156 hold the plurality of media 99 therebetween. As a result, the holding unit 153 holds the plurality of media 99.

The holding unit 153 moves vertically while holding the plurality of media 99. Specifically, the holding unit 153 moves upward to downward with the plurality of the mediums 99 being held. At this time, the holding unit 153 accelerates downward at an acceleration that is faster than gravitational acceleration. In this case, when the holding unit 153 moves downward, the lower end of the medium 99 moves away from the holding surface 157. When the holding unit 153 is decelerated by approaching the bottom surface 137, the lower end of the medium 99 collides with the holding surface 157. This imparts vibration to the lower end of the medium 99. In this regard, the holding unit 153 is a vibration imparting unit. In the fourth embodiment, the supply control unit 48 imparts vibration to the medium 99 by operating the holding 153 when the sensor 47 detects that the holding cassette 152 is mounted to the housing 41. Dust, paper powder, etc. are removed from the medium 99 by causing the lower end of the medium 99 to collide with the holding surface 157 once or a plurality of times.

When the lower end of the medium 99 contacts the holding surface 157, the position of the lower end of the medium 99 is aligned. When the position of the lower end of the medium 99 is aligned, the position of the upper end of the medium 99 is also aligned. In this regard, the holding unit 153 is an alignment unit that aligns the medium 99.

According to the fourth embodiment, the same effects as those of the third embodiment can be obtained.

The above-mentioned first to fourth embodiments can be modified and implemented as follows. The first embodiment, the second embodiment, the third embodiment, the fourth embodiment, and the following modified examples can be implemented in combination with each other in combination within a range in which a technical contradiction does not arise.

The processing executed by the processing unit 13 on the medium 99 may include reading of an image of the medium 99, or stapling of the medium 99. In other words, the processing device 11 according to the first to fourth embodiments is a printing device that prints an image on the medium 99, however, the processing device 11 may be a reading device that reads an image of the medium 99, or may be a post-processing device that performs post-processing on the medium 99.

The accommodating unit is not limited to the cassette 42 that is attached to and detached from the housing 41, and may simply be a case for accommodating the medium 99.

The supply device 18 of the first embodiment may include a configuration for collecting dust, paper powder, etc., such as the casing 103 and the suction unit 106 provided in the supply device 101 of the second embodiment.

The rotating bodies 58 may repeatedly move upward and downward when imparting vibration to the medium 99.

In the second process, the medium 99 may be operated so as to only collide with the first cursor 121 and the second cursor 122. In other words, in the second process, processing from step S28 to step S32 may be skipped.

In the second process, the medium 99 may be operated so as to only collide with the third cursor 123 and the fourth cursor 124. In other words, in the second process, processing from step S23 to step S27 may be skipped.

In step S22 of the second process, the variable N may be set to 3 or may be set to 2. That is, processing from step S23 to step S34 may end in the first loop or end in the second loop.

In step S26 and step S31 of the second process, the table 104 may be returned to the normal position, and then the table 104 may be moved toward the cursors 105. In this manner, the acceleration distances of the table 104 when moving toward the first cursor 121, the second cursor 122, the third cursor 123, and the fourth cursor 124 are equal, so that the impact applied to the medium 99 is equalized.

The rotating bodies 58 may be provided in the cursors 105.

In the third embodiment, the medium 99 may collide with the third side surface 135 and the fourth side surface 136.

The liquid discharged by the head 21 is not limited to ink, and may be, for example, a liquid material in which particles of functional materials are dispersed or mixed in the liquid. For example, the head 21 may discharge a liquid material containing a material such as an electrode material or a pixel material used in manufacture of liquid crystal display, an electroluminescent display, and a surface emitting display, etc. in a dispersed or dissolved form.

Hereinafter, technical concepts and effects thereof that are understood from the above-described exemplary embodiments and modified examples will be described.

(A) A supply device is configured to supply a medium to a processing unit configured to perform processing on the medium, the supply device including an accommodating unit configured to accommodate a plurality of the media in a state of being stacked therein and a vibration imparting unit configured to contact ends of the plurality of media accommodated in the accommodating unit to impart vibration to the medium.

According to the above-described configuration, the vibration imparting unit contacts the end of the plurality of media, thereby imparting vibration to the plurality of media. Thus, dust can be removed from the plurality of media.

(B) In the above-described supply device, the accommodating unit may include a placement surface at which the medium to be accommodated is placed, and the vibration imparting unit may impart vibration in a direction orthogonal to a front surface of the medium placed at the placement surface.

The vibration in a direction orthogonal to the surface is more easily imparted to the medium than when the vibration in a direction along the surface thereof is imparted. Thus, according to the above-described configuration, the medium is effectively vibrated.

(C) In the above-described supply device, the vibration imparting unit may be configured to contact a portion of an end of the medium, the portion not configured to overlap the placement surface when the placement surface is viewed in plan view.

The portion of the end of the medium that does not overlap the placement surface is not supported by the placement surface, and thus is prone to vibration. Thus, according to the above-described configuration, the medium is effectively vibrated.

(D) The above-described supply device may include a clamping unit configured to contact a portion of the medium to clamp the medium, the portion configured to overlap the placement surface when the placement surface is viewed in plan view, wherein the vibration imparting unit may be configured to contact the medium clamped by the clamping unit to impart vibration to the medium.

According to the above-described configuration, the portion clamped by the clamping unit acts as the fixed end, and the portion where the vibration imparting unit comes into contact acts as the free end, so that the medium placed at the placement surface vibrates. In this case, the vibration of the medium has higher frequency in comparison to a case where the medium is not clamped by the clamping unit. In other words, the vibration frequency of the medium is increased. As a result, dust is effectively removed.

(E) In the above-described supply device, the clamping unit may include a pickup roller configured to feed the medium placed at the placement surface.

According to the above-described configuration, the pickup roller that feeds the medium also functions as the clamping unit, so the configuration of the supply device can be simplified.

(F) In the above-described supply device, the vibration imparting unit may include a rotary shaft and a rotating member configured to rotate about the rotary shaft, the rotating member may include a vane configured to extend outward, and the vane may be configured to rotate to come into contact, from below, with the end of the medium placed at the placement surface.

According to the above-described configuration, the vane contacts the end of the medium so as to lift up the end of the medium. The end of the medium drops downward by the action of gravity after being lifted up by the vane. Conversely, when the rotating member rotates so that the vane comes into contact with the end of the medium from above, the end of the medium is displaced upward by the rigidity of the medium itself after being depressed by the vane. Thus, when the rotating member rotates so that the vane comes into contact, from below, with the end of the medium, the medium vibrates effectively since the gravity acts more effectively than when the rotating member rotates so that the vane contact the end of the medium from above.

(G) The above-described supply device may include an alignment unit configured to contact the medium accommodated in the accommodating unit to align the medium, wherein the alignment unit may be configured to move to contact the medium, and the vibration imparting unit may be configured to move together with the alignment unit.

According to the above-described configuration, the vibration imparting unit moves as the alignment unit moves. Therefore, regardless of the size of the medium accommodated in the accommodating unit, the vibration imparting unit can contact the end of the medium. That is, the vibration imparting unit can impart vibration to the medium regardless of the size of the medium.

(H) In the above-described supply device, the alignment unit may include the vibration imparting unit, and the alignment unit may be configured to align the medium while imparting vibration to the medium.

According to the above-described configuration, it is possible to efficiently impart vibration to the medium and align the medium.

(I) In the above-described supply device, the accommodating unit may include a placement surface at which the medium is placed, the placement surface may be configured to move in a direction along the placement surface, the alignment unit may be configured, by moving the placement surface toward the alignment unit to cause the medium to come into contact with the alignment unit from a state with the medium placed at the placement surface being not in contact with the alignment unit, to impart vibration to the medium, and in a process of imparting vibration to the medium a plurality of times by moving the placement surface to cause the medium to contact the alignment unit a plurality of times, a distance between the placement surface and the alignment unit in a state with the medium placed at the placement surface being not in contact with the alignment unit when the placement surface moves toward the alignment unit, may be longer than a distance between the placement surface and the alignment unit in a state with the medium placed at the placement surface being not in contact with the alignment unit when the placement surface subsequently moves toward the alignment unit.

According to the above-described configuration, the alignment unit repeatedly contacts the medium placed at the placement surface, thereby imparting vibration to the medium repeatedly. In the process in which vibration is imparted to the medium a plurality of times, the distance between the placement surface and the alignment unit gradually decreases. In other words, the magnitude of the vibration imparted to the medium is reduced. By imparting different magnitudes of vibration, dust can be effectively removed from the medium.

(J) In the above-described supply device, a plurality of the vibration imparting units may be provided, and each of the plurality of vibration imparting units may be configured to contact respective different ends with respect to the medium. According to the above-described configuration, the medium effectively vibrates compared to a case where only one vibration imparting unit is provided.

(K) In the above-described supply device, the vibration imparting unit may be configured to move upward and downward.

According to the above-described configuration, the vibration imparting unit can effectively contact the plurality of media to be stacked. (L) In the above-described supply device, the accommodating unit may include a placement surface at which the medium is placed, the supply device may include a casing located below the placement surface and a suction unit coupled with the casing, the casing may include an opening and an accommodating chamber leading to the opening, and the suction unit may be configured to perform suction from the accommodating chamber.

According to the above-described configuration, the dust falling from the medium by imparting vibration to the vibration imparting unit is collected in the accommodating chamber through the opening. The risk of dust removed from the medium flying up can be reduced.

(L) In the above-described supply device, the accommodating unit may include a first accommodating unit, the supply device may include a second accommodating unit configured to accommodate a plurality of the media in a state of being stacked therein and a plurality of delivery paths respectively corresponding to the first accommodating unit and the second accommodating unit, the medium being fed toward the processing unit, and each of the plurality of delivery paths may be coupled to one another.

According to the above-described configuration, the medium from which dust has been removed in the first accommodating unit can be fed through the delivery path toward the second accommodating unit. Therefore, even when the vibration imparting unit is not able to impart vibration to the medium accommodated in the second accommodating unit, dust can be removed from the medium accommodated in the second accommodating unit.

(K) In the above-described supply device, the first accommodating unit may be located below the second accommodating unit.

According to the above-described configuration, the risk of dust removed from the medium by the first accommodating unit reaching the second accommodating unit is reduced.

(O) In the above-described supply device, the accommodating unit may include a placement surface at which the medium is placed, and the placement surface may be configured to contact ends of the plurality of media to be stacked. According to the above-described configuration, the supply device can be miniaturized in a direction along the placement surface.

(P) The processing device includes the above-described supply device and the processing unit.

According to the above-described configuration, the same effects as those of the supply device can be obtained.

(Q) In the above-described processing device, the accommodating unit may be configured to vertically overlap the processing unit.

According to the above-described configuration, the installation area of the processing device can be reduced compared to a case where the accommodating unit does not overlap the processing unit vertically. Note that the vertical direction in which the accommodating unit and the processing unit overlap each other may be a direction orthogonal to the installation surface of the processing device.

(R) A control method for a supply device configured to supply a medium to a processing unit, the supply device including an accommodating unit configured to accommodate a plurality of the media in a state of being stacked therein and a vibration imparting unit configured to contact ends of the plurality of media accommodated in the accommodating unit to impart vibration to the medium, wherein the method includes imparting vibration to the medium by the vibration imparting unit when the medium is accommodated in the accommodating unit.

According to the method described above, the same effects as those of the supply device can be obtained.

(S) A program for causing a control unit to execute control of a supply device configured to supply a medium to a processing unit, the supply device including an accommodating unit configured to accommodate a plurality of the media in a state of being stacked therein and a vibration imparting unit configured to contact ends of the plurality of media accommodated in the accommodating unit to impart vibration to the medium, wherein the program causes the vibration imparting unit to impart vibration to the medium when the medium is accommodated in the accommodating unit.

According to the program described above, the same effects as those of the supply device can be obtained.

The invention claimed is:

1. A supply device configured to supply a medium to a processing unit configured to perform processing on the medium, the supply device comprising:

an accommodating unit configured to accommodate a plurality of media including the medium in a state of being stacked therein;

an alignment unit configured to contact the plurality of media accommodated in the accommodating unit to align the plurality of media, wherein the alignment unit is configured to move to contact the plurality of media; and a vibration imparting unit configured to move together with the alignment unit and to contact ends of the plurality of media accommodated in the accommodating unit to impart vibration to the medium.

2. The supply device according to claim 1, wherein the accommodating unit includes a placement surface at which the medium to be accommodated is placed, and the vibration imparting unit imparts vibration in a direction orthogonal to a front surface of the medium placed at the placement surface.

3. The supply device according to claim 2, wherein the vibration imparting unit is configured to contact a portion of an end of the medium, the portion not overlapping the placement surface when the placement surface is viewed in plan view.

4. The supply device according to claim 2, comprising a clamping unit configured to contact a portion of the medium to clamp the medium, the portion overlapping the placement surface when the placement surface is viewed in plan view, wherein the vibration imparting unit is configured to contact the medium clamped by the clamping unit to impart vibration to the medium.

5. The supply device according to claim 4, wherein the clamping unit includes a pickup roller configured to feed the medium placed at the placement surface.

6. The supply device according to claim 2, wherein the vibration imparting unit includes:

a rotary shaft; and a rotating member configured to rotate about the rotary shaft, the rotating member includes a vane extending outward, and the vane is configured to rotate to come into contact, from below, with an end of the medium placed at the placement surface.

7. The supply device according to claim 1, wherein the alignment unit includes the vibration imparting unit, and the alignment unit is configured to align the medium while imparting vibration to the medium.

8. The supply device according to claim 7, wherein the accommodating unit includes a placement surface at which the medium is placed, the placement surface is configured to move in a direction along the placement surface, the alignment unit is configured to, by moving the placement surface toward the alignment unit, cause the medium, placed at the placement surface and not in a contact state with the alignment unit, to come into contact with the alignment unit, thereby imparting vibration to the medium, and in a process of imparting vibration to the medium a plurality of times by moving the placement surface to cause the medium to contact the alignment unit a plurality of times, a distance between the placement surface and the alignment unit in a state where the medium placed at the placement surface is not in contact with the alignment unit when the placement surface moves toward the alignment unit, is longer than a distance between the placement surface and the alignment unit in a state where the medium placed at the placement surface is not in contact with the alignment unit when the placement surface subsequently moves toward the alignment unit.

9. The supply device according to claim 1, wherein a plurality of the vibration imparting units are provided, and the plurality of vibration imparting units are configured to contact different ends of the medium respectively.

10. The supply device according to claim 1, wherein the vibration imparting unit is configured to move upward and downward.

11. The supply device according to claim 1, wherein the accommodating unit includes a placement surface at which the medium is placed, the supply device includes a casing located below the placement surface and a suction unit coupled with the casing, the casing includes an opening and an accommodating chamber leading to the opening, and the suction unit is configured to perform suction from the accommodating chamber.

12. The supply device according to claim 1, wherein the accommodating unit includes a first accommodating unit, and the supply device includes:

a second accommodating unit configured to accommodate a plurality of the media in a state of being stacked therein, and a plurality of delivery paths respectively corresponding to the first accommodating unit and the second accommodating unit, and on which the medium is fed toward the processing unit, and the plurality of delivery paths are coupled to one another.

13. The supply device according to claim 12, wherein the first accommodating unit is located below the second accommodating unit.

14. The supply device according to claim 1, wherein the accommodating unit includes a placement surface at which the medium is placed, and the placement surface is configured to contact ends of the plurality of media stacked.

15. A processing device, comprising:

the supply device according to claim 1; and the processing unit.

16. The processing device according to claim 15, wherein the accommodating unit vertically overlaps the processing unit.

17. A control method for a supply device including:

an accommodating unit configured to accommodate a plurality of media including a medium in a state of being stacked therein;

an alignment unit configured to contact the plurality of media accommodated in the accommodating unit to align the plurality of media, wherein the alignment unit is configured to move to contact the plurality of media; and a vibration imparting unit configured to move together with the alignment unit and to contact ends of the plurality of media accommodated in the accommodating unit to impart vibration to the medium, and the supply device being configured to supply the medium to a processing unit, wherein the method comprises imparting vibration to the medium by the vibration imparting unit when the medium is accommodated in the accommodating unit.

18. A non-transitory computer-readable storage medium storing a program for causing a control unit to execute control of a supply device including:

an accommodating unit configured to accommodate a plurality of media including a medium in a state of being stacked therein;

an alignment unit configured to contact the plurality of media accommodated in the accommodating unit to align the plurality of media, wherein the alignment unit is configured to move to contact the plurality of media; and a vibration imparting unit configured to move together with the alignment unit and to contact ends of the plurality of media accommodated in the accommodating unit to impart vibration to the medium, and the supply device being configured to supply the medium to a processing unit, wherein the program causes the vibration imparting unit to impart vibration to the medium when the medium is accommodated in the accommodating unit.

* * * * *